US011560867B2

(12) United States Patent
Yoshimura

(10) Patent No.: US 11,560,867 B2
(45) Date of Patent: Jan. 24, 2023

(54) FUEL FLOW PASSAGE MEMBER AND FUEL INJECTION VALVE INCLUDING THE SAME

(71) Applicant: DENSO CORPORATION, Kariya (JP)

(72) Inventor: Tetsuya Yoshimura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/398,365

(22) Filed: Aug. 10, 2021

(65) Prior Publication Data

US 2021/0363953 A1 Nov. 25, 2021

Related U.S. Application Data

(63) Continuation of application No. PCT/JP2020/005211, filed on Feb. 11, 2020.

(30) Foreign Application Priority Data

Feb. 12, 2019 (JP) ..... JP2019-022754

(51) Int. Cl.
*F02M 61/16* (2006.01)
*F02M 47/02* (2006.01)
*F02M 61/18* (2006.01)

(52) U.S. Cl.
CPC ..... *F02M 61/168* (2013.01); *F02M 47/027* (2013.01); *F02M 61/18* (2013.01); *F02M 2200/8084* (2013.01)

(58) Field of Classification Search
CPC ..... F02M 2200/8084; F02M 47/027; F02M 51/0657; F02M 61/166; F02M 61/168; F02M 61/18
See application file for complete search history.

(56) References Cited

U.S. PATENT DOCUMENTS

2008/0296414 A1 12/2008 Kubota et al.
2019/0331076 A1 10/2019 Saizen et al.
2021/0040926 A1* 2/2021 Miyake ..... F02M 51/0685

FOREIGN PATENT DOCUMENTS

JP 11-166461 6/1999
JP 2006-083808 3/2006
JP 2010-31674 2/2010

* cited by examiner

*Primary Examiner* — Grant Moubry
*Assistant Examiner* — Ruben Picon-Feliciano
(74) *Attorney, Agent, or Firm* — Nixon & Vanderhye P.C.

(57) ABSTRACT

A first tubular portion forms a part of a fuel flow passage therein. A first joint surface is formed in one end surface of the first tubular portion. A first inner diameter enlarged portion is formed on a side opposite to the first joint surface. A second tubular portion forms a part of the fuel flow passage therein. A second joint surface is formed in one end surface of the second tubular portion and joined to the first joint surface. A second inner diameter enlarged portion is formed on a side opposite to the second joint surface. A welded portion is formed in an annular shape to extend radially inward from the radially outside of the first joint surface and the second joint surface by welding the first tubular portion and the second tubular portion.

14 Claims, 16 Drawing Sheets

FUEL FLOW PASSAGE MEMBER AND FUEL INJECTION VALVE INCLUDING THE SAME

CROSS REFERENCE TO RELATED APPLICATION

The present application is a continuation application of International Patent Application No. PCT/JP2020/005211 filed on Feb. 11, 2020, which designated the U. S. and claims the benefit of priority from Japanese Patent Application No. 2019-022754 filed on Feb. 12, 2019. The entire disclosures of all of the above applications are incorporated herein by reference.

TECHNICAL FIELD

The present disclosure relates to a fuel flow passage member and a fuel injection valve including the same.

BACKGROUND

Conventionally, a fuel injection valve includes a fuel flow passage member that forms a fuel flow passage through which fuel flows.

SUMMARY

According to an aspect of the present disclosure, a fuel flow passage member includes a first member, a second member, and a welded portion. The first member includes a first tubular portion, a first end portion, a first joint surface, and a first inner diameter enlarged portion. The first tubular portion forms a part of a fuel flow passage through which fuel flows therein. The first end portion is formed at one end of the first tubular portion. The first joint surface is formed in one end surface of the first tubular portion. The first inner diameter enlarged portion is formed on the side opposite to the first joint surface with respect to the first end portion of the first tubular portion and has an inner diameter that is larger than the inner diameter of the first end portion.

The second member includes a second tubular portion, a second end portion, a second joint surface, a second inner diameter enlarged portion. The second tubular portion forms a part of the fuel flow passage therein. The second end portion is formed at one end of the second tubular portion. The second joint surface is formed in one end surface of the second tubular portion and joined to the first joint surface. The second inner diameter enlarged portion is formed on the side opposite to the second joint surface with respect to the second end portion of the second tubular portion and has an inner diameter that is larger than the inner diameter of the second end portion.

The welded portion is formed in an annular shape so as to extend radially inward from the radially outside of the first joint surface and the second joint surface by welding the first tubular portion and the second tubular portion.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
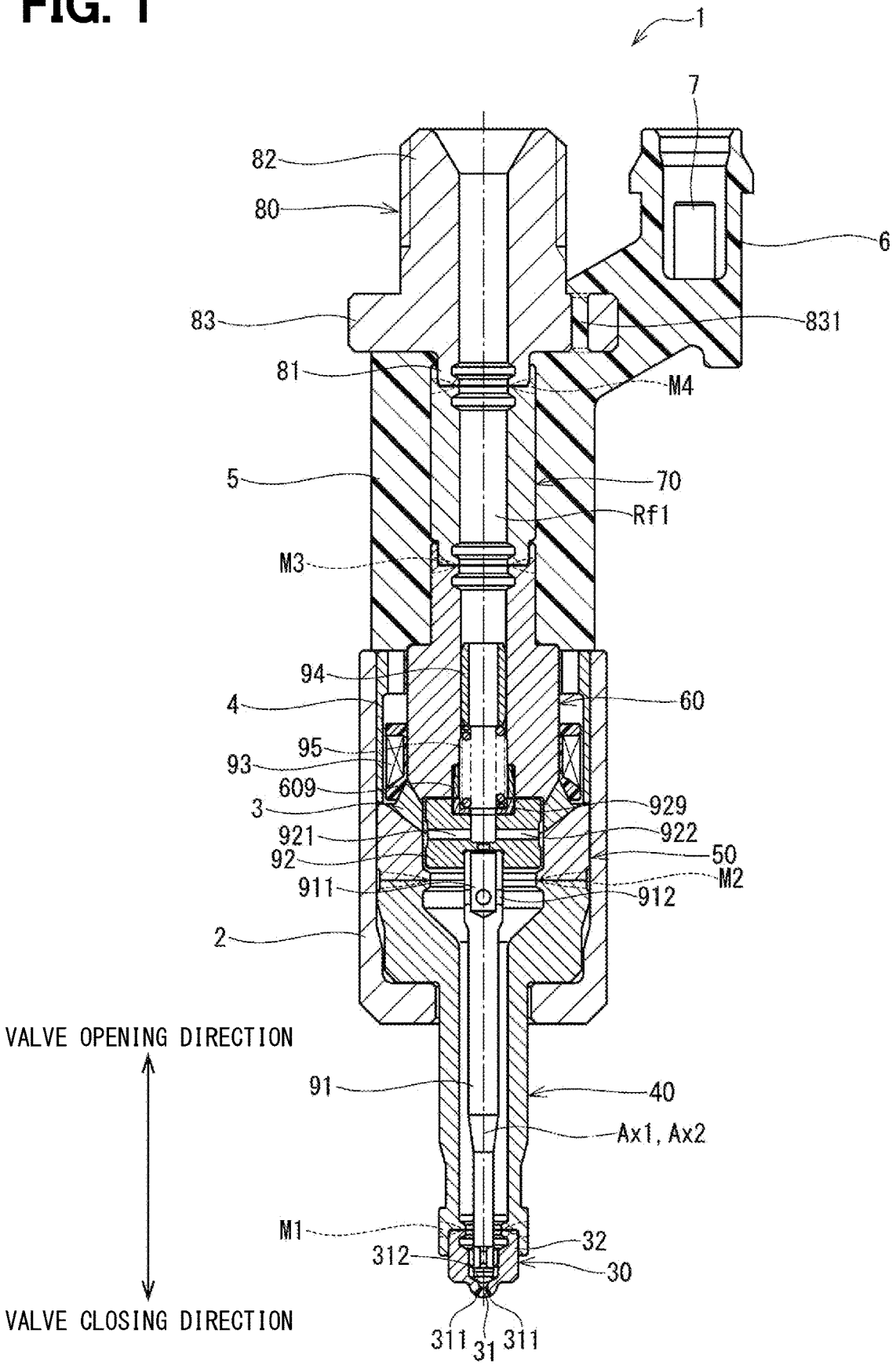
FIG. 1 is a cross-sectional view showing a fuel injection valve according to a first embodiment.

Hereinafter, examples of the present disclosure will be described.

According to an example of the present disclosure, a fuel injection valve includes a fuel flow passage member that forms a fuel flow passage through which fuel flows. The fuel flow passage member is formed by joining multiple tubular portions in the axial direction.

According to an example of the present disclosure, two tubular portions are welded together, and a welded portion is formed at a portion on the radially outside of joint surfaces of the two tubular portions. On the other hand, a welded portion is not formed on the radially inner portion of the joint surfaces of the two tubular portions in consideration of suppressing intrusion of spatter into the fuel flow passage. Therefore, in a case where pressure of fuel in the fuel flow passage rises, the fuel may enter the portion between the radially inner portions of the joint surfaces of the two tubular portions, and the pressure may act in the direction in which the two joint surfaces are separated. As a result, stress in the welded portion increases, and the welded portion may be damaged.

According to an example of the present disclosure, a fuel flow passage member includes a first member, a second member, and a welded portion. The first member includes a first tubular portion, a first end portion, a first joint surface, and a first inner diameter enlarged portion. The first tubular portion forms a part of a fuel flow passage through which fuel flows therein. The first end portion is formed at one end of the first tubular portion. The first joint surface is formed in one end surface of the first tubular portion. The first inner diameter enlarged portion is formed on the side opposite to the first joint surface with respect to the first end portion of the first tubular portion and has an inner diameter that is larger than the inner diameter of the first end portion.

The second member includes a second tubular portion, a second end portion, a second joint surface, a second inner diameter enlarged portion. The second tubular portion forms a part of the fuel flow passage therein. The second end portion is formed at one end of the second tubular portion. The second joint surface is formed in one end surface of the second tubular portion and joined to the first joint surface. The second inner diameter enlarged portion is formed on the side opposite to the second joint surface with respect to the second end portion of the second tubular portion and has an inner diameter that is larger than the inner diameter of the second end portion.

The welded portion is formed in an annular shape so as to extend radially inward from the radially outside of the first joint surface and the second joint surface by welding the first tubular portion and the second tubular portion. The inner diameter of the welded portion is larger than the inner diameter of the first end portion and the inner diameter of the second end portion.

The first inner diameter enlarged portion is formed on the upstream side with respect to the first joint surface and the second joint surface, and the second inner diameter enlarged portion is formed on the downstream side with respect to the first joint surface and the second joint surface. Therefore, even in a case where fuel intrudes between the first joint surface and the second joint surface, and the pressure acts in a direction in which the first joint surface and the second joint surface are separated from each other, the pressure of fuel in the first inner diameter enlarged portion and the second inner diameter enlarged portion acts in the direction in which the first end portion and the second end portion approach each other, that is, in the direction in which the first joint surface and the second joint surface approach each other. In this way, the pressure in the vertical direction acting in the direction in which the first joint surface and the second joint surface are separated from each other can be canceled. Therefore, the stress in the welded portion can be reduced with a simple configuration, and damage caused in the welded portion can be restricted.

Hereinafter, the fuel flow passage member and the fuel injection valve according to multiple embodiments will be described with reference to the drawings. Components that are substantially the same in the plurality of embodiments are denoted by the same reference numerals and will not be described. Further, substantially identical elements in the embodiments achieve the same or similar effects.

First Embodiment

A fuel injection valve according to the first embodiment is shown in FIG. 1. A fuel injection valve 1 is applied to, for example, a gasoline engine as an internal combustion engine (hereinafter simply referred to as "engine"), and injects gasoline as fuel and supplies the fuel to the engine. The fuel injection valve 1 directly injects fuel into the combustion chamber of the engine. Thus, the fuel injection valve 1 is applied to a direct injection gasoline engine.

Next, a basic configuration of the fuel injection valve 1 will be described with reference to FIG. 1. The fuel injection valve 1 includes a nozzle 30, a housing 40, a housing 50, a magnetic throttle portion 3, a fixed core 60, a pipe 70, an inlet 80, a needle 91, a movable core 92, an adjusting pipe 94, a spring 95, a coil 93, and a tubular member 4, a holder 2, a mold portion 5, a connector portion 6, and the like.

The nozzle 30 is made of, for example, a metallic material. The nozzle 30 has an injection portion 31 and a second tubular portion 32 (see FIG. 2). The second tubular portion 32 is formed in a substantially tubular shape, and forms a part of a fuel flow passage Rf1 therein. The injection portion 31 is integrally formed with the second tubular portion 32 so as to close an end portion of the second tubular portion 32. The injection portion 31 has an injection hole 311 and a valve seat 312. The injection hole 311 is formed so as to communicate the fuel flow passage Rf1 with the outside of the nozzle 30. For example, multiple injection holes 311 are formed in the circumferential direction of the injection portion 31 at constant intervals. The valve seat 312 is formed in an annular shape around the injection hole 311 on a surface of the injection portion 31 on the side of the fuel flow passage Rf1.

The housing 40 is formed of, for example, a metallic material in a tubular shape, and forms a part of the fuel flow passage Rf1 therein. One end of the housing 40 is connected to an end of the second tubular portion 32 of the nozzle 30 on the side opposite to the injection portion 31. The housing 40 and the nozzle 30 are joined together by welding. The joining of the housing 40 and the nozzle 30 will be described in detail later.

The housing 50 is formed of, for example, a magnetic material in a tubular shape, and forms a part of the fuel flow passage Rf1 therein. One end of the housing 50 is connected to the other end of the housing 40. The housing 50 and the housing 40 are joined together by welding. The joining of the housing 50 and the housing 40 will be described in detail later.

The magnetic throttle portion 3 is formed of, for example, a non-magnetic material in an annular shape, and forms a part of the fuel flow passage Rf1 therein. One end of the magnetic throttle portion 3 is connected to an end portion of the housing 50 on the side opposite to the housing 40. The magnetic throttle portion 3 and the housing 50 are joined together by welding.

The fixed core 60 is formed of, for example, a magnetic material in a tubular shape, and forms a part of the fuel flow passage Rf1 therein. One end of the fixed core 60 is connected to an end of the magnetic throttle portion 3 on the side opposite to the housing 50. The fixed core 60 and the magnetic throttle portion 3 are joined together by, for example, welding.

The pipe 70 is formed of, for example, a metallic material in a tubular shape, and forms a part of the fuel flow passage Rf1 therein. One end of the pipe 70 is connected to an end of the fixed core 60 on the side opposite to the magnetic throttle portion 3. The pipe 70 and the fixed core 60 are joined together by welding. The joining of the pipe 70 and the fixed core 60 will be described in detail later.

The inlet 80 is formed of, for example, a metallic material in a tubular shape, and forms a part of the fuel flow passage Rf1 therein. One end of the inlet 80 is connected to an end of the pipe 70 on the side opposite to the fixed core 60. The inlet 80 and the pipe 70 are joined together by welding. The joining of the inlet 80 and the pipe 70 will be described in detail later.

As described above, the fuel flow passage Rf1 is formed inside the inlet 80, the pipe 70, the fixed core 60, the magnetic throttle portion 3, the housing 50, the housing 40, and the nozzle 30. The fuel injection valve 1 is provided to the engine so that the injection hole 311 of the nozzle 30 is exposed to the combustion chamber of the engine.

The inlet 80 has a second tubular portion 82 in a tubular shape on the other end side. A fuel pipe (not shown) is connected to the end of the second tubular portion 82 on the side opposite to the pipe 70. With this configuration, fuel in the fuel pipe flows into the fuel flow passage Rf1. The fuel that has flowed into the fuel flow passage Rf1 is injected into the combustion chamber from the injection hole 311 of the nozzle 30.

The needle 91 is made of, for example, a metallic material in a bar shape. The needle 91 is provided in the fuel flow passage Rf1 inside the nozzle 30, the housing 40, and the housing 50 so as to be reciprocally movable in the axial direction. The outer wall of one end of the needle 91 is slidable with the inner wall of the second tubular portion 32 of the nozzle 30. With this configuration, the needle 91 is guided to move in the axial direction. One end of the needle 91 is configured to come into contact with the valve seat 312 of the nozzle 30. The needle 91 performs valve opening when one end of the needle 91 is separated from the valve seat 312 to allow fuel to be injected from the injection hole 311. The needle 91 performs valve closing when one end of the needle 91 comes into contact with the valve seat 312 to stop injection of fuel from the injection hole 311. In this way, the needle 91 is provided in the fuel flow passage Rf1 and is configured to open and close the injection hole 311. Hereinafter, the direction in which the needle 91 moves away from the valve seat 312 is referred to as a "valve opening direction", and the direction in which the needle 91 approaches the valve seat 312 is referred to as a "valve closing direction".

The movable core 92 has a substantially tubular shape, and is made of magnetic material, for example. The movable core 92 is provided in the fuel flow passage Rf1 inside the housing 50 and the magnetic throttle portion 3 so as to be joined to the other end of the needle 91. Therefore, the movable core 92 can move integrally with the needle 91 in the fuel flow passage Rf1.

The movable core 92 is provided with a bush 929. The bush 929 is formed, for example, a metallic material in a tubular shape and is provided at the center of the end portion of the movable core 92 on the side of the fixed core 60. The bush 929 is provided so as to project slightly toward the fixed core 60 from the end surface of the movable core 92 on the side of the fixed core 60. The bush 929 is movable integrally with the movable core 92.

The fixed core 60 is provided with a bush 609. The bush 609 is made of, for example, a metallic material in a tubular shape, and is fitted to the inner wall of the end portion of the fixed core 60 on the side of the movable core 92. The bush 609 is provided so as to project slightly toward the movable core 92 from a surface of the fixed core 60 facing the movable core 92. The bush 609 is fixed to the fixed core 60.

The bush 929 and the bush 609 are configured to be brought into contact with each other. When the bush 929 and the bush 609 come into contact with each other, the movement of the bush 929, the movable core 92, and the needle 91 in the valve opening direction is restricted. On the other hand, when the needle 91 comes into contact with the valve seat 312, the movement of the bush 929, the movable core 92, and the needle 91 in the valve closing direction is restricted. In this way, the bush 929, the movable core 92, and the needle 91 are configured to reciprocate between the valve seat 312 and the bush 609.

The adjusting pipe 94 is formed of, for example, a metal in a tubular shape, and is press-fitted inside the fixed core 60. The spring 95 is, for example, a coil spring, and is provided inside the fixed core 60 so that one end abuts the bush 929 and the other end abuts the adjusting pipe 94. The spring 95 is configured to urge the bush 929, the movable core 92, and the needle 91 toward the injection hole 311, that is, in the valve closing direction. The biasing force of the spring 95 is adjusted by a position of the adjusting pipe 94 with respect to the fixed core 60.

The coil 93 includes a winding, is formed in a substantially tubular shape, and is provided so as to be located on the radially outside of a connection portion between the magnetic throttle portion 3 and the fixed core 60. The tubular member 4 is formed of, for example, a magnetic material in a tubular shape. One end of the tubular member 4 is located radially outside of the coil 93 and abuts the housing 50. The inner wall of the other end of the tubular member 4 abuts the outer wall of the fixed core 60. The holder 2 is formed of, for example, a magnetic material in a tubular shape. One end of the holder 2 is in contact with the radially outside of the end of the housing 40 on the side of the housing 50. The inner wall of the other end of the holder 2 is in contact with the outer wall of the tubular member 4. A part of the inner wall of the holder 2 is in contact with the outer wall of the housing 50. With this configuration, the housing 50, the holder 2, the tubular member 4, and the fixed core 60 are magnetically connected.

The coil 93 generates a magnetic force when electric power is supplied (energized). When a magnetic force is generated in the coil 93, a magnetic circuit is formed in the movable core 92, the housing 50, the holder 2, the tubular member 4, and the fixed core 60, avoiding the magnetic throttle portion 3 as the magnetic throttle portion. Thereby, a magnetic attraction force is generated between the fixed core 60 and the movable core 92, and the movable core 92 is attracted toward the fixed core 60 together with the needle 91. Therefore, the needle 91 moves in the valve opening direction, separates from the valve seat 312, and performs the valve opening. As a result, injection holes 13 are opened. Thus, when the coil 93 is energized, it is possible to attract the movable core 92 toward the fixed core 60 and to move the needle 91 to the side opposite to the valve seat 312.

When the movable core 92 is attracted toward the fixed core 60 (valve opening direction) by the magnetic attraction force, the bush 929 collides with the bush 609. In this way, the movement of the movable core 92 in the valve opening direction is restricted.

When the energization of the coil 93 is stopped while the movable core 92 is attracted toward the fixed core 60, the needle 91 and the movable core 92 are urged toward the valve seat 312 by the urging force of the spring 95. As a result, the needle 91 moves in the valve closing direction to come into contact with the valve seat 312 and performs the valve closing. As a result, the injection holes 13 are closed.

The inlet 80 has an enlarged diameter portion 83 that projects radially outward from the outer wall of the end portion of the second tubular portion 82 on the side of the pipe 70. A hole portion 831 is formed in the enlarged diameter portion 83. The hole portion 831 is formed so as to penetrate the enlarged diameter portion 83 in the axial direction at a specific portion of the enlarged diameter portion 83 in the circumferential direction (see FIG. 1).

The mold portion 5 is formed of resin between the holder 2 and the tubular member 4 and the enlarged diameter portion 83 of the inlet 80 so as to mold the end portion of the fixed core 60 on the side of the pipe 70 and the radially outside of the pipe 70.

The connector portion 6 is integrally molded of resin with the mold portion 5 so as to protrude from a portion of the mold portion 5 near the hole portion 831. A terminal 7 is insert-molded in the connector portion 6 for supplying electric power to the coil 93. Herein, an end portion of the connector portion 6 on the side of the mold portion 5 straddles the surface of the enlarged diameter portion 83 on the side of the injection hole 311 and the surface of the enlarged diameter portion 83 on the side opposite to the injection hole 311. In addition, a part of the end portion of the connector portion 6 on the side of the mold portion 5 is located inside the hole portion 831. With this configuration, vibration of the connector portion 6 can be suppressed.

Fuel that has flowed into the inlet 80 from the fuel pipe (not shown) flows through the fuel flow passage Rf1 and is guided toward the injection hole 311. An electronic control unit (not shown) controls the opening and closing of the injection hole 311 by the needle 91 by controlling the energization of the coil 93 according to an operating state of the vehicle and the like. This controls the injection of fuel into the combustion chamber of the engine.

Next, the joining between the housing 40 and the nozzle 30 will be described with reference to FIG. 2. The housing 40 and the nozzle 30 correspond to a "first member" and a "second member", respectively, and form a "fuel flow passage member".

The housing 40 as a "first member" has a first tubular portion 41, a first end portion 411, a first joint surface 412, a first inner diameter enlarged portion 413, a surface 414, and an upper extended portion 416. The first tubular portion 41 is formed in a substantially tubular shape at one end of the housing 40, and forms a part of the fuel flow passage Rf1 therein. The first end portion 411 is formed at one end of the first tubular portion 41. The first joint surface 412 is formed in a substantially annular shape on the inner periphery portion of one end surface of the first tubular portion 41.

The first inner diameter enlarged portion 413 is formed on the side opposite to the first joint surface 412 with respect to the first end portion 411 of the first tubular portion 41, and the inner diameter of the first inner diameter enlarged portion 413 is larger than the inner diameter of the first end portion 411. With this configuration, the surface 414 in an annular shape is formed in a stepped surface shape between the inner wall of the first end portion 411 and the inner wall of the first inner diameter enlarged portion 413.

The upper extended portion 416 is formed so as to extend in a tubular shape from the outer periphery portion of one end surface of the first tubular portion 41.

The nozzle 30 as a "second member" has the second tubular portion 32, a second end portion 321 and a second joint surface 322, a second inner diameter enlarged portion 323, a surface 324, and a lower inner diameter reduced portion 325. The second tubular portion 32 is formed in a substantially tubular shape at one end of the nozzle 30, and forms a part of the fuel flow passage Rf1 therein. The second end portion 321 is formed at one end of the second tubular portion 32. The second joint surface 322 is formed in a substantially annular shape on one end surface of the second tubular portion 32 and is joined to the first joint surface 412. The inner diameter of the second end portion 321 is substantially the same as the inner diameter of the first end portion 411.

The second inner diameter enlarged portion 323 is formed on the side opposite to the second joint surface 322 with respect to the second end portion 321 of the second tubular portion 32. The inner diameter of the second inner diameter enlarged portion 323 is larger than the inner diameter of the second end portion 321. With this configuration, the surface 324 in an annular shape is formed in a stepped surface shape between the inner wall of the second end portion 321 and the inner wall of the second inner diameter enlarged portion 323. The inner diameter of the second inner diameter enlarged portion 323 is substantially the same as the inner diameter of the first inner diameter enlarged portion 413.

The lower inner diameter reduced portion 325 is formed on the side opposite to the second end portion 321 with respect to the second inner diameter enlarged portion 323 of the second tubular portion 32. The inner diameter of the lower inner diameter reduced portion 325 is smaller than the inner diameter of the second inner diameter enlarged portion 323. The inner diameter of the lower inner diameter reduced portion 325 is smaller than the inner diameter of the second end portion 321.

A welded portion M1 is formed at the joint portion between the housing 40 and the nozzle 30. The welded portion M1 is formed in an annular shape so as to extend radially inward from the radially outside of the first joint surface 412 and the second joint surface 322 by welding the first tubular portion 41 and the second tubular portion 32. In the present embodiment, the welded portion M1 is formed so as to extend radially inward from the outer walls of the first end portion 411 and the upper extended portion 416 (see FIG. 2). The inner diameter of the welded portion M1 is larger than the inner diameter of the first end portion 411 and the inner diameter of the second end portion 321. That is, the welded portion M1 is not exposed on the inner walls of the first end portion 411 and the second end portion 321.

In the present embodiment, the first inner diameter enlarged portion 413 is formed on the upstream side with respect to the first joint surface 412 and the second joint surface 322, and the second inner diameter enlarged portion 323 is formed on the downstream side with respect to the first joint surface 412 and the second joint surface 322.

Therefore, even in a case where fuel in the fuel flow passage Rf1 intrudes between the inner periphery portion of the first joint surface 412 and the inner periphery portion of the second joint surface 322, and the pressure acts in a direction in which the first joint surface 412 and the second joint surface 322 are separated from each other, the pressure of fuel in the first inner diameter enlarged portion 413 and the second inner diameter enlarged portion 323 acts in the direction in which the first end portion 411 and the second end portion 321 approach each other, that is, in the direction in which the first joint surface 412 and the second joint surface 322 approach each other. In this way, the pressure acting in the vertical direction, that is, in the valve opening direction and the valve closing direction, that is, the pressure acting in the direction in which the first joint surface 412 and the second joint surface 322 are separated from each other can be canceled. Therefore, the stress in the welded portion M1 can be reduced with a simple configuration, and damage caused in the welded portion M1 can be restricted.

In the present embodiment, the inner diameter of the welded portion M1 is smaller than the inner diameter of the first inner diameter enlarged portion 413 and the inner diameter of the second inner diameter enlarged portion 323.

Therefore, it is possible to restrict fuel in the fuel flow passage Rf1 from entering the portion between the inner periphery portion of the first joint surface 412 and the inner periphery portion of the second joint surface 322. With this configuration, even in a case where pressure of fuel in the fuel flow passage Rf1 becomes high, the pressure in the direction in which the first tubular portion 41 and the second tubular portion 32 are separated from each other, that is, in the axial direction can be restricted from acting on the first tubular portion 41 and the second tubular portion 32. Therefore, the stress in the welded portion M1 can be further reduced, and damage caused in the welded portion M1 can be further restricted.

In the present embodiment, the housing 40 as the first member has the surface 414 as a first inclined surface that is on the side opposite to the first joint surface 412 with respect to the first end portion 411 and is formed so as to be inclined with respect to the first joint surface 412. The nozzle 30 as the second member has the surface 324 as a second inclined surface that is on the side opposite to the second joint surface 322 with respect to the second end portion 321 and is formed so as to be inclined with respect to the second joint surface 322. The surface 414 and the surface 324 are formed in a tapered surface shape.

With this configuration, load acting in the direction in which the first joint surface 412 and the second joint surface 322 approach each other and caused by the pressure of fuel in the first inner diameter enlarged portion 413 and the second inner diameter enlarged portion 323 can be efficiently applied to the inner peripheries of the first end portion 411 and the second end portion 321. Thus, damage of the welded portion M1 can be further restricted.

Further, the surfaces 414 and 324 are formed so as to be inclined with respect to the first joint surface 412 and the second joint surface 322. Therefore, workability of the first inner diameter enlarged portion 413 and the second inner diameter enlarged portion 323 can be improved.

Figure 2:
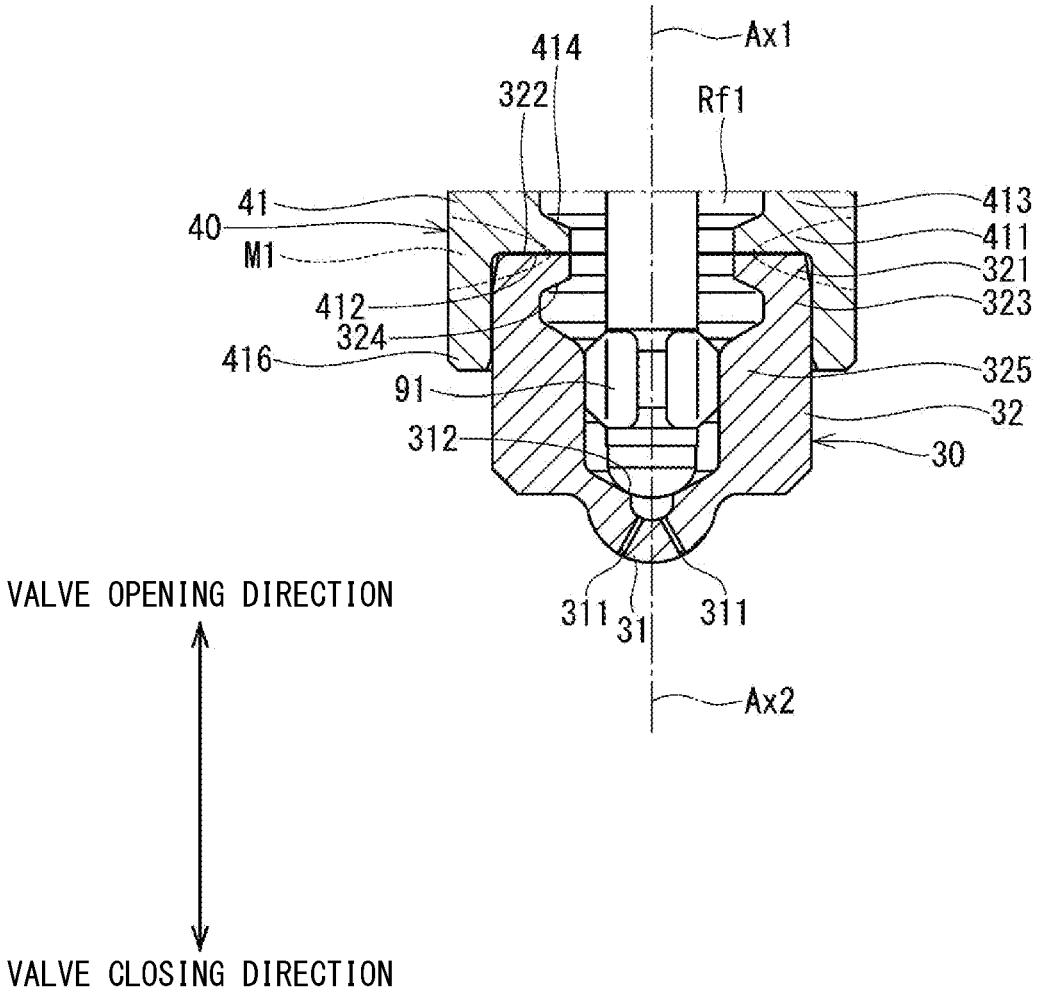
FIG. 2 is a cross-sectional view showing a joint portion between a housing and a nozzle of a fuel injection valve according to the first embodiment.

In the present embodiment, in the cross section including the axis Ax1 of the first tubular portion 41, the surface 414 of the first end portion 411 on the side opposite to the first joint surface 412 and the surface 324 of the second end portion 321 on the side opposite to the second joint surface 322 are formed so as to be symmetrical with respect to the first joint surface 412 and the second joint surface 322 (see FIG. 2).

Therefore, it is possible to restrict stress due to the difference in shape between the upper and lower surfaces of the first end portion 411 and the second end portion 321 and due to the difference in the amount of deformation between the housing 40 and the nozzle 30. Thus, damage of the welded portion M1 can be further restricted.

In the present embodiment, the first joint surface 412 and the second joint surface 322 are formed so as to be perpendicular to, that is, non-parallel to the axis Ax1 of the first tubular portion 41 and the axis Ax2 of the second tubular portion 32.

Therefore, even in a case where pressure acts on the inner walls of the first end portion 411 and the second end portion 321 radially outside, it is possible to restrict the first joint surface 412 and the second joint surface 322 from separating from each other. Thus, damage of the welded portion M1 can be further restricted.

Herein, the term "perpendicular" with respect to the axes Ax1 and Ax2 is not limited to the state where the axes are exactly perpendicular to the axes Ax1 and Ax2, but also includes a slightly inclined state. The same is applied below.

In the present embodiment, the housing 40 as the first member includes the upper extended portion 416 that extends in a tubular shape from the outer periphery portion of one end surface of the first tubular portion 41 and its inner peripheral wall is configured to abut the outer peripheral wall of the second tubular portion 32.

Therefore, the housing 40 as the first member and the nozzle 30 as the second member can be positioned in the radial direction with a simple configuration.

In the present embodiment, the nozzle 30 as the second member has the lower inner diameter reduced portion 325 that is formed on the side opposite to the second end portion 321 with respect to the second inner diameter enlarged portion 323 of the second tubular portion 32. The inner diameter of the lower inner diameter reduced portion 325 is smaller than the inner diameter of the second inner diameter enlarged portion 323.

Therefore, the second end portion 321, the second inner diameter enlarged portion 323, and the lower inner diameter reduced portion 325 can be formed at the same time by cutting the second tubular portion 32 so that a part of the substantially tubular inner wall of the second tubular portion 32 in the axial direction is annularly recessed outward in the radial direction.

Next, the joining between the housing 50 and the housing 40 will be described with reference to FIG. 3. The housing 50 and the housing 40 correspond to a "first member" and a "second member", respectively, and form a "fuel flow passage member".

The housing 50 as a "first member" has a first tubular portion 51, a first end portion 511, a first joint surface 512, a first inner diameter enlarged portion 513, and a surface 514. The first tubular portion 51 is formed in a substantially tubular shape at one end of the housing 50, and forms a part of the fuel flow passage Rf1 therein. The first end portion 511 is formed at one end of the first tubular portion 51. The first joint surface 512 is formed in a substantially annular shape on one end surface of the first tubular portion 51.

The first inner diameter enlarged portion 513 is formed on the side opposite to the first joint surface 512 with respect to the first end portion 511 of the first tubular portion 51. The inner diameter of the first inner diameter enlarged portion 513 is larger than the inner diameter of the first end portion 511. With this configuration, the surface 514 in an annular shape is formed in a stepped surface shape between the inner wall of the first end portion 511 and the inner wall of the first inner diameter enlarged portion 513.

The housing 40 as a "second member" has a second tubular portion 42, a second end portion 421, a second joint surface 422, a second inner diameter enlarged portion 423, a surface 424, and a lower inner diameter reduced portion 425. The second tubular portion 42 is formed in a substantially tubular shape at one end of the housing 40, and forms a part of the fuel flow passage Rf1 therein. The second end portion 421 is formed at one end of the second tubular portion 42. The second joint surface 422 is formed in a substantially annular shape on one end surface of the second tubular portion 42 and is joined to the first joint surface 512. The inner diameter of the second end portion 421 is substantially the same as the inner diameter of the first end portion 511.

The second inner diameter enlarged portion 423 is formed on the side opposite to the second joint surface 422 with respect to the second end portion 421 of the second tubular portion 42. The inner diameter of the second inner diameter enlarged portion 423 is larger than the inner diameter of the second end portion 421. With this configuration, the surface 424 in an annular shape is formed in a stepped surface shape between the inner wall of the second end portion 421 and the inner wall of the second inner diameter enlarged portion 423. The inner diameter of the second inner diameter enlarged portion 423 is substantially the same as the inner diameter of the first inner diameter enlarged portion 413.

The lower inner diameter reduced portion 425 is formed on the side opposite to the second end portion 421 with respect to the second inner diameter enlarged portion 423 of the second tubular portion 42. The inner diameter of the lower inner diameter reduced portion 425 is smaller than the inner diameter of the second inner diameter enlarged portion 423. The inner diameter of the lower inner diameter reduced portion 425 is smaller than the inner diameter of the second end portion 421.

A welded portion M2 is formed at the joint portion between the housing 50 and the housing 40. The welded portion M2 is formed in an annular shape so as to extend radially inward from the radially outside of the first joint surface 512 and the second joint surface 422 by fusing the first tubular portion 51 and the second tubular portion 42 by welding (see FIG. 3). The inner diameter of the welded portion M2 is larger than the inner diameter of the first end portion 511 and the inner diameter of the second end portion 421. That is, the welded portion M2 is not exposed on the inner walls of the first end portion 511 and the second end portion 421.

In the present embodiment, the first inner diameter enlarged portion 513 is formed on the upstream side with respect to the first joint surface 512 and the second joint surface 422, and the second inner diameter enlarged portion 423 is formed on the downstream side with respect to the first joint surface 512 and the second joint surface 422.

Therefore, even in a case where fuel in the fuel flow passage Rf1 intrudes between the inner periphery portion of the first joint surface 512 and the inner periphery portion of the second joint surface 422, and the pressure acts in a direction in which the first joint surface 512 and the second joint surface 422 are separated from each other, the pressure of fuel in the first inner diameter enlarged portion 513 and the second inner diameter enlarged portion 423 acts in the direction in which the first end portion 511 and the second end portion 421 approach each other, that is, in the direction in which the first joint surface 512 and the second joint surface 422 approach each other. In this way, the pressure acting in the vertical direction, that is, in the valve opening direction and the valve closing direction, that is, the pressure acting in the direction in which the first joint surface 512 and the second joint surface 422 are separated from each other can be canceled. Therefore, the stress in the welded portion M2 can be reduced with a simple configuration, and damage caused in the welded portion M2 can be restricted.

In the present embodiment, the inner diameter of the welded portion M2 is smaller than the inner diameter of the first inner diameter enlarged portion 513 and the inner diameter of the second inner diameter enlarged portion 423.

Therefore, it is possible to restrict fuel in the fuel flow passage Rf1 from entering the portion between the inner periphery portion of the first joint surface 512 and the inner periphery portion of the second joint surface 422. With this configuration, even in a case where pressure of fuel in the fuel flow passage Rf1 becomes high, the pressure in the direction in which the first tubular portion 51 and the second tubular portion 42 are separated from each other, that is, in the axial direction can be restricted from acting on the first tubular portion 51 and the second tubular portion 42. Therefore, the stress in the welded portion M2 can be further reduced, and damage caused in the welded portion M2 can be further restricted.

In the present embodiment, the housing 50 as the first member has the surface 514 as a first inclined surface that is on the side opposite to the first joint surface 512 with respect to the first end portion 511 and is formed so as to be inclined with respect to the first joint surface 512. The housing 40 as the second member has the surface 424 as a second inclined surface that is on the side opposite to the second joint surface 422 with respect to the second end portion 421 and is formed so as to be inclined with respect to the second joint surface 422. The surface 514 and the surface 424 are formed in a tapered surface shape.

With this configuration, load acting in the direction in which the first joint surface 512 and the second joint surface 422 approach each other and caused by the pressure of fuel in the first inner diameter enlarged portion 513 and the second inner diameter enlarged portion 423 can be efficiently applied to the inner peripheries of the first end portion 511 and the second end portion 421. Thus, damage of the welded portion M2 can be further restricted.

Further, the surfaces 514 and 424 are formed so as to be inclined with respect to the first joint surface 512 and the second joint surface 422. Therefore, workability of the first inner diameter enlarged portion 513 and the second inner diameter enlarged portion 423 can be improved.

Figure 3:
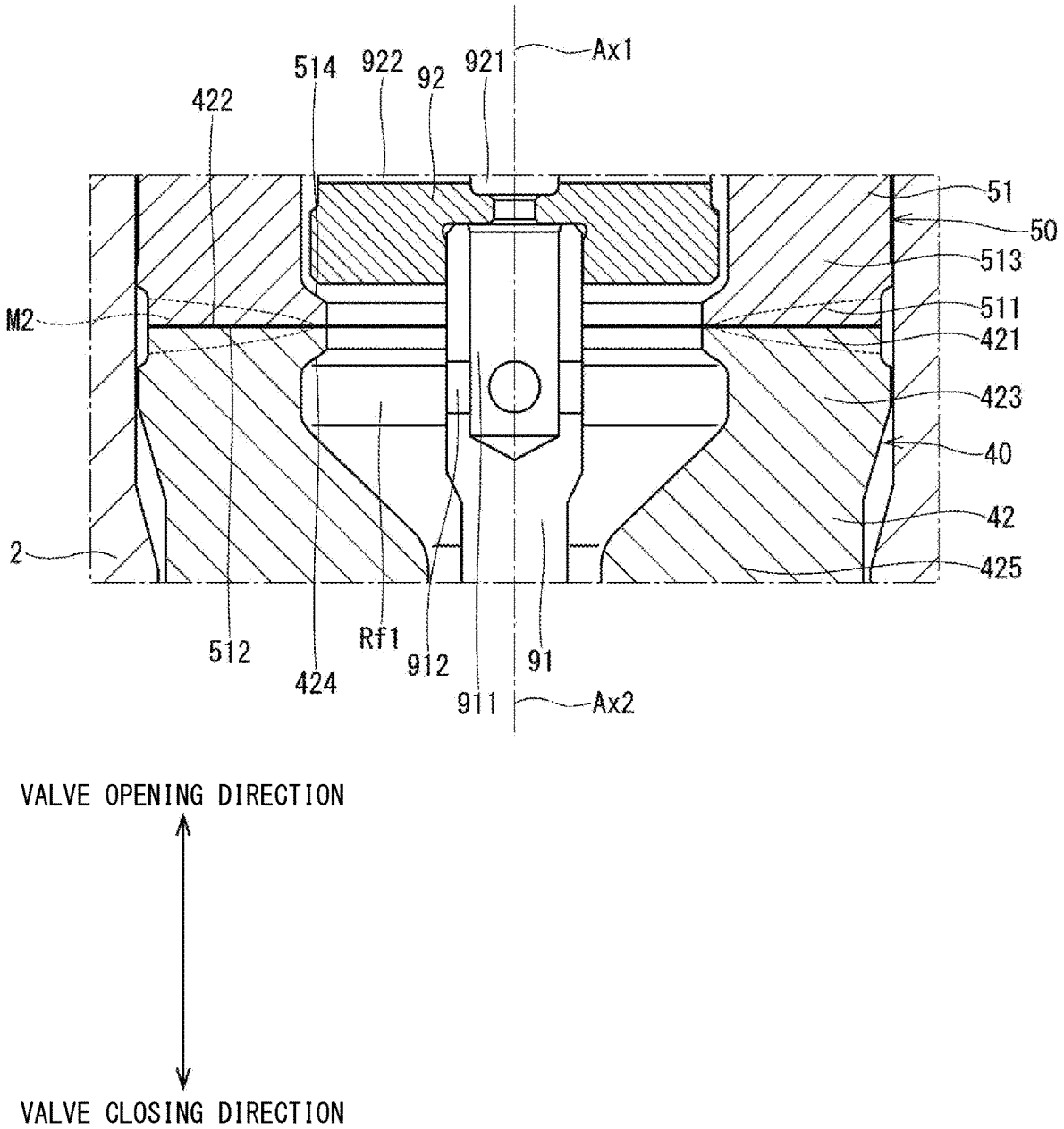
FIG. 3 is a cross-sectional view showing the joint portion of the housing of the fuel injection valve according to the first embodiment.

In the present embodiment, in the cross section including the axis Ax1 of the first tubular portion 51, the surface 514 of the first end portion 511 on the side opposite to the first joint surface 512 and the surface 424 of the second end portion 421 on the side opposite to the second joint surface 422 are formed so as to be symmetrical with respect to the first joint surface 512 and the second joint surface 422 (see FIG. 3).

Therefore, it is possible to restrict stress due to the difference in shape between the upper and lower surfaces of the first end portion 511 and the second end portion 421 and due to the difference in the amount of deformation between the housing 50 and the housing 40. Thus, damage of the welded portion M2 can be further restricted.

In the present embodiment, the first joint surface 512 and the second joint surface 422 are formed so as to be perpendicular to, that is, non-parallel to the axis Ax1 of the first tubular portion 51 and the axis Ax2 of the second tubular portion 42.

Therefore, even in a case where pressure acts on the inner walls of the first end portion 511 and the second end portion 421 radially outside, it is possible to restrict the first joint surface 512 and the second joint surface 422 from separating from each other. Thus, damage of the welded portion M2 can be further restricted.

In the present embodiment, the housing 40 as the second member has the lower inner diameter reduced portion 425 that is formed on the side opposite to the second end portion 421 with respect to the second inner diameter enlarged portion 423 of the second tubular portion 42. The inner diameter of the lower inner diameter reduced portion 425 is smaller than the inner diameter of the second inner diameter enlarged portion 423.

Therefore, the second end portion 421, the second inner diameter enlarged portion 423, and the lower inner diameter reduced portion 425 can be formed at the same time by cutting the second tubular portion 42 so that a part of the substantially tubular inner wall of the second tubular portion 42 in the axial direction is annularly recessed outward in the radial direction.

As shown in FIG. 3, the movable core 92 is formed with an axial hole portion 921 and a radial hole portion 922. The axial hole portion 921 is formed so as to penetrate the movable core 92 in the axial direction. The radial hole portion 922 extends in the movable core 92 in the radial direction so as to connect the axial hole portion 921 with the outer wall of the movable core 92.

The needle 91 is formed with an axial hole portion 911 and a radial hole portion 912. The axial hole portion 911 is formed so as to extend from an end portion of the needle 91 on the opposite side to the injection hole 311 toward the injection hole 311. The radial hole portion 912 extends in the needle 91 in the radial direction so as to connect the axial hole portion 911 with the outer wall of the needle 91.

The axial hole portion 921 of the movable core 92 connects the inside of the bush 929 with the axial hole portion 911 of the needle 91. With this configuration, fuel on the side opposite to the movable core 92 with respect to the bush 929 is enabled to flow through the inside of the bush 929, the axial hole portion 921, the axial hole portion 911, and the radial hole portion 912, and to flow toward the injection hole 311 with respect to the movable core 92.

Next, the joining of the pipe 70 and the fixed core 60 will be described with reference to FIG. 4. The pipe 70 and the fixed core 60 correspond to a "first member" and a "second member", respectively, and form a "fuel flow passage member".

The pipe 70 as the "first member" has a first tubular portion 71, a first end portion 711, a first joint surface 712, a first inner diameter enlarged portion 713, a surface 714, and an upper inner diameter reduced portion 715. The first tubular portion 71 is formed in a substantially tubular shape at one end of the pipe 70, and forms a part of the fuel flow passage Rf1 therein. The first end portion 711 is formed at one end of the first tubular portion 71. The first joint surface 712 is formed in a substantially annular shape on one end surface of the first tubular portion 71.

The first inner diameter enlarged portion 713 is formed on the side opposite to the first joint surface 712 with respect to the first end portion 711 of the first tubular portion 71. The inner diameter of the first inner diameter enlarged portion 713 is larger than the inner diameter of the first end portion 711. With this configuration, the surface 714 in an annular shape is formed in a stepped surface shape between the inner wall of the first end portion 711 and the inner wall of the first inner diameter enlarged portion 713.

The upper inner diameter reduced portion 715 is formed on the side opposite to the first end portion 711 with respect to the first inner diameter enlarged portion 713 of the first tubular portion 71. The inner diameter of the upper inner diameter reduced portion 715 is smaller than the inner diameter of the first inner diameter enlarged portion 713. The inner diameter of the upper inner diameter reduced portion 715 is substantially the same as the inner diameter of the first end portion 711.

The first tubular portion 71 has a reduced diameter portion 717 on one end side. The outer diameter of the reduced diameter portion 717 is smaller than the outer diameter of a portion of the first tubular portion 71 other than the reduced diameter portion 717.

The fixed core 60 as the "second member" includes a second tubular portion 62, a second end portion 621, a second joint surface 622, a second inner diameter enlarged portion 623, a surface 624, a lower inner diameter reduced portion 625, and a lower extended portion 626. The second tubular portion 62 is formed in a substantially tubular shape at one end of the fixed core 60, and forms a part of the fuel flow passage Rf1 therein. The second end portion 621 is formed at one end of the second tubular portion 62. The second joint surface 622 is formed in a substantially annular shape on the inner periphery portion of one end surface of the second tubular portion 62 and is joined to the first joint surface 712. The inner diameter of the second end portion 621 is substantially the same as the inner diameter of the first end portion 711.

The second inner diameter enlarged portion 623 is formed on the side opposite to the second joint surface 622 with respect to the second end portion 621 of the second tubular portion 62. The inner diameter of the second inner diameter enlarged portion 623 is larger than the inner diameter of the second end portion 621. With this configuration, the surface 624 in an annular shape is formed in a stepped surface shape between the inner wall of the second end portion 621 and the inner wall of the second inner diameter enlarged portion 623. The inner diameter of the second inner diameter enlarged portion 623 is substantially the same as the inner diameter of the first inner diameter enlarged portion 713.

The lower inner diameter reduced portion 625 is formed on the side opposite to the second end portion 621 with respect to the second inner diameter enlarged portion 623 of the second tubular portion 62. The inner diameter of the lower inner diameter reduced portion 625 is smaller than the inner diameter of the second inner diameter enlarged portion 623. The inner diameter of the lower inner diameter reduced portion 625 is substantially the same as the inner diameter of the second end portion 621.

The lower extended portion 626 is formed so as to extend in a tubular shape from the outer periphery portion of one end surface of the second tubular portion 62.

A welded portion M3 is formed at the joint portion between the pipe 70 and the fixed core 60. The welded portion M3 is formed in an annular shape so as to extend radially inward from the radially outside of the first joint surface 712 and the second joint surface 622 by welding the first tubular portion 71 and the second tubular portion 62. In the present embodiment, the welded portion M3 is formed so as to extend radially inward from the outer walls of the second end portion 621 and the lower extended portion 626 (see FIG. 4). The inner diameter of the welded portion M3 is larger than the inner diameter of the first end portion 711 and the inner diameter of the second end portion 621. That is, the welded portion M3 is not exposed on the inner walls of the first end portion 711 and the second end portion 621.

In the present embodiment, the first inner diameter enlarged portion 713 is formed on the upstream side with respect to the first joint surface 712 and the second joint surface 622, and the second inner diameter enlarged portion 623 is formed on the downstream side with respect to the first joint surface 712 and the second joint surface 622.

Therefore, even in a case where fuel in the fuel flow passage Rf1 intrudes between the inner periphery portion of the first joint surface 712 and the inner periphery portion of the second joint surface 622, and the pressure acts in a direction in which the first joint surface 712 and the second joint surface 622 are separated from each other, the pressure of fuel in the first inner diameter enlarged portion 713 and the second inner diameter enlarged portion 623 acts in the direction in which the first end portion 711 and the second end portion 621 approach each other, that is, in the direction in which the first joint surface 712 and the second joint surface 622 approach each other. In this way, the pressure acting in the vertical direction, that is, in the valve opening direction and the valve closing direction, that is, the pressure acting in the direction in which the first joint surface 712 and the second joint surface 622 are separated from each other can be canceled. Therefore, the stress in the welded portion M3 can be reduced with a simple configuration, and damage caused in the welded portion M3 can be restricted.

In the present embodiment, the inner diameter of the welded portion M3 is smaller than the inner diameter of the first inner diameter enlarged portion 713 and the inner diameter of the second inner diameter enlarged portion 623.

Therefore, it is possible to restrict fuel in the fuel flow passage Rf1 from entering the portion between the inner periphery portion of the first joint surface 712 and the inner periphery portion of the second joint surface 622. With this configuration, even in a case where pressure of fuel in the fuel flow passage Rf1 becomes high, the pressure in the direction in which the first tubular portion 71 and the second tubular portion 62 are separated from each other, that is, in the axial direction can be restricted from acting on the first tubular portion 71 and the second tubular portion 62. Therefore, the stress in the welded portion M3 can be further reduced, and damage caused in the welded portion M3 can be further restricted.

In the present embodiment, the pipe 70 as the first member has the surface 714 as a first inclined surface that is on the side opposite to the first joint surface 712 with respect to the first end portion 711 and is formed so as to be inclined with respect to the first joint surface 712. The fixed core 60 as the second member has the surface 624 as a second inclined surface that is formed on the side opposite to the second joint surface 622 with respect to the second end portion 621 and is so as to be inclined with respect to the second joint surface 622. The surface 714 and the surface 624 are formed in a tapered surface shape.

With this configuration, load acting in the direction in which the first joint surface 712 and the second joint surface 622 approach each other and caused by the pressure of fuel in the first inner diameter enlarged portion 713 and the second inner diameter enlarged portion 623 can be efficiently applied to the inner peripheries of the first end portion 711 and the second end portion 621. Thus, damage of the welded portion M3 can be further restricted.

Further, the surfaces 714 and 624 are formed so as to be inclined with respect to the first joint surface 712 and the second joint surface 622. Therefore, workability of the first inner diameter enlarged portion 713 and the second inner diameter enlarged portion 623 can be improved.

Figure 4:
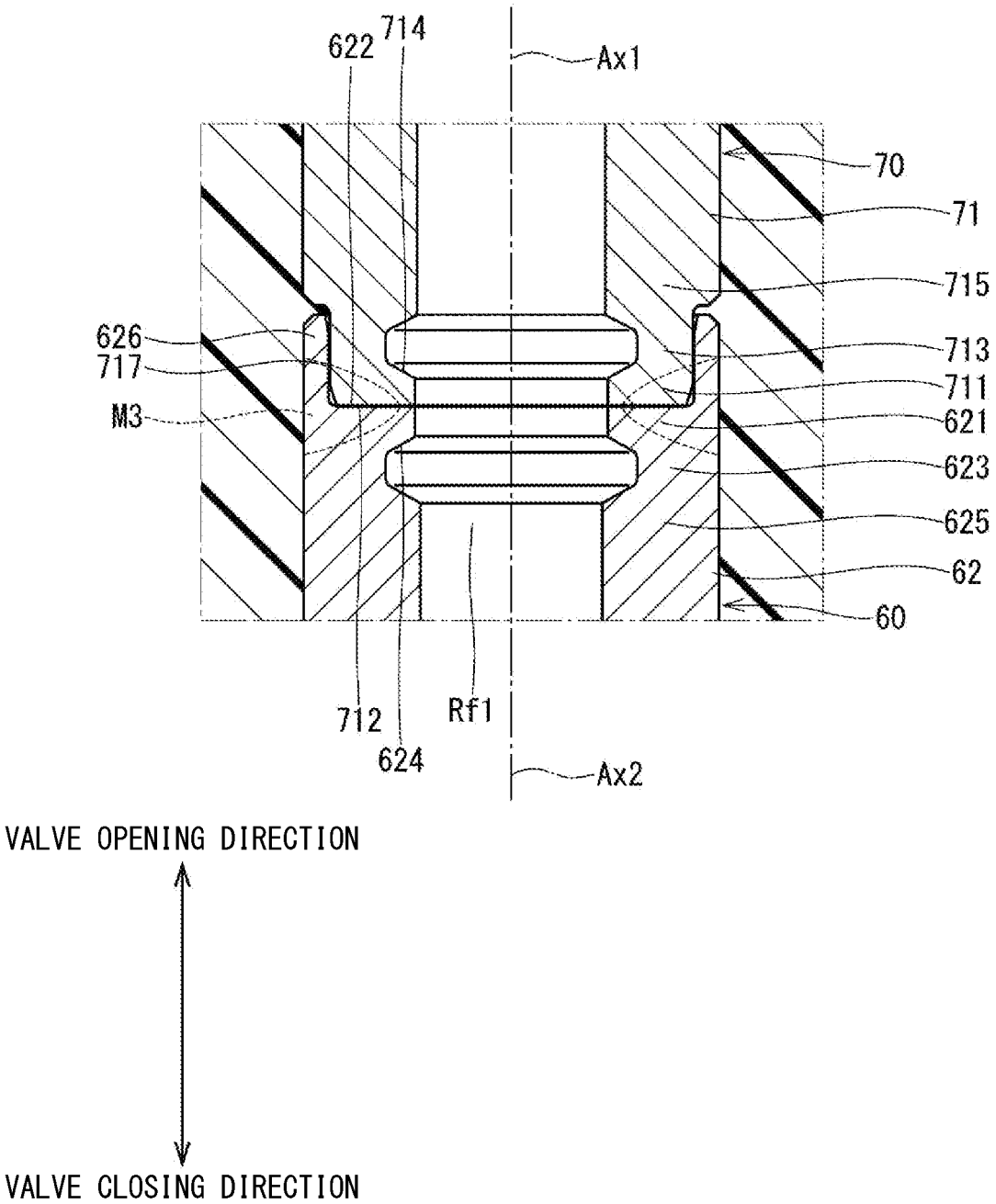
FIG. 4 is a cross-sectional view showing a joint portion between a pipe and a fixed core of the fuel injection valve according to the first embodiment.

In the present embodiment, in the cross section including the axis Ax1 of the first tubular portion 71, the surface 714 of the first end portion 711 on the side opposite to the first joint surface 712 and the surface 624 of the second end portion 621 on the side opposite to the second joint surface 622 are formed so as to be symmetrical with respect to the first joint surface 712 and the second joint surface 622 (see FIG. 4).

Therefore, it is possible to restrict stress due to the difference in shape between the upper and lower surfaces of the first end portion 711 and the second end portion 621 and due to the difference in the amount of deformation between the pipe 70 and the fixed core 60. Thus, damage of the welded portion M3 can be further restricted.

In the present embodiment, the first joint surface 712 and the second joint surface 622 are formed so as to be perpendicular to, that is, non-parallel to the axis Ax1 of the first tubular portion 71 and the axis Ax2 of the second tubular portion 62.

Therefore, even in a case where pressure acts on the inner walls of the first end portion 711 and the second end portion 621 radially outside, it is possible to restrict the first joint surface 712 and the second joint surface 622 from separating from each other. Thus, damage of the welded portion M3 can be further restricted.

In the present embodiment, the fixed core 60 as the second member has the lower extended portion 626 that extends in a tubular shape from the outer periphery portion of one end surface of the second tubular portion 62, and its inner peripheral wall is configured to abut the outer peripheral wall of the reduced diameter portion 717 of the first tubular portion 71.

Therefore, the pipe 70 as the first member and the fixed core 60 as the second member can be positioned in the radial direction with a simple configuration.

In the present embodiment, the pipe 70 as the first member has the upper inner diameter reduced portion 715 that is formed on the side opposite to the first end portion 711 with respect to the first inner diameter enlarged portion 713 of the first tubular portion 71. The inner diameter of the upper inner diameter reduced portion 715 is smaller than the inner diameter of the first inner diameter enlarged portion 713.

Therefore, the first end portion 711, the first inner diameter enlarged portion 713, and the upper inner diameter reduced portion 715 can be formed at the same time by cutting the first tubular portion 71 so that a part of the substantially tubular inner wall of the first tubular portion 71 in the axial direction is annularly recessed outward in the radial direction.

In the present embodiment, the fixed core 60 as the second member has the lower inner diameter reduced portion 625 that is formed on the side opposite to the second end portion 621 with respect to the second inner diameter enlarged portion 623 of the second tubular portion 62. The inner diameter of the lower inner diameter reduced portion 625 is smaller than the inner diameter of the second inner diameter enlarged portion 623.

Therefore, the second end portion 621, the second inner diameter enlarged portion 623, and the lower inner diameter reduced portion 625 can be formed at the same time by cutting the second tubular portion 62 so that a part of the substantially tubular inner wall of the second tubular portion 62 in the axial direction is annularly recessed outward in the radial direction.

Next, the joining of the inlet 80 and the pipe 70 will be described with reference to FIG. 5. The inlet 80 and the pipe 70 correspond to a "first member" and a "second member", respectively, and form a "fuel flow passage member".

The inlet 80 as the "first member" has a first tubular portion 81, a first end portion 811, a first joint surface 812, a first inner diameter enlarged portion 813, a surface 814, and an upper inner diameter reduced portion 815. The first tubular portion 81 is formed in a substantially tubular shape at one end of the inlet 80, and forms a part of the fuel flow passage Rf1 therein. The first end portion 811 is formed at one end of the first tubular portion 81. The first joint surface 812 is formed in a substantially annular shape on one end surface of the first tubular portion 81.

The first inner diameter enlarged portion 813 is formed on the side opposite to the first joint surface 812 with respect to the first end portion 811 of the first tubular portion 81. The inner diameter of the first inner diameter enlarged portion 813 is larger than the inner diameter of the first end portion 811. With this configuration, the surface 814 in an annular shape is formed in a stepped surface shape between the inner wall of the first end portion 811 and the inner wall of the first inner diameter enlarged portion 813.

The upper inner diameter reduced portion 815 is formed on the side opposite to the first end portion 811 with respect to the first inner diameter enlarged portion 813 of the first tubular portion 81. The inner diameter of the upper inner diameter reduced portion 815 is smaller than the inner diameter of the first inner diameter enlarged portion 813. The inner diameter of the upper inner diameter reduced portion 815 is substantially the same as the inner diameter of the first end portion 811.

The pipe 70 as the "second member" includes a second tubular portion 72, a second end portion 721, a second joint surface 722, a second inner diameter enlarged portion 723, a surface 724, a lower inner diameter reduced portion 725, and a lower extended portion 726. The second tubular portion 72 is formed in a substantially tubular shape at one end of the pipe 70, and forms a part of the fuel flow passage Rf1 therein. The second end portion 721 is formed at one end of the second tubular portion 72. The second joint surface 722 is formed in a substantially annular shape on the inner periphery portion of one end surface of the second tubular portion 72 and is joined to the first joint surface 812. The inner diameter of the second end portion 721 is substantially the same as the inner diameter of the first end portion 811.

The second inner diameter enlarged portion 723 is formed on the side opposite to the second joint surface 722 with respect to the second end portion 721 of the second tubular portion 72. The inner diameter of the second inner diameter enlarged portion 723 is larger than the inner diameter of the second end portion 721. With this configuration, the surface 724 in an annular shape is formed in a stepped surface shape between the inner wall of the second end portion 721 and the inner wall of the second inner diameter enlarged portion 723. The inner diameter of the second inner diameter enlarged portion 723 is substantially the same as the inner diameter of the first inner diameter enlarged portion 813.

The lower inner diameter reduced portion 725 is formed on the side opposite to the second end portion 721 with respect to the second inner diameter enlarged portion 723 of the second tubular portion 72. The inner diameter of the lower inner diameter reduced portion 725 is smaller than the inner diameter of the second inner diameter enlarged portion 723. The inner diameter of the lower inner diameter reduced portion 725 is substantially the same as the inner diameter of the second end portion 721.

The lower extended portion 726 is formed so as to extend in a tubular shape from the outer periphery portion of one end surface of the second tubular portion 72.

A welded portion M4 is formed at the joint portion between the inlet 80 and the pipe 70. The welded portion M4 is formed in an annular shape so as to extend radially inward from the radially outside of the first joint surface 812 and the second joint surface 722 by welding the first tubular portion 81 and the second tubular portion 72. In the present embodiment, the welded portion M4 is formed so as to extend radially inward from the outer walls of the second end portion 721 and the lower extended portion 726 (see FIG. 5). The inner diameter of the welded portion M4 is larger than the inner diameter of the first end portion 811 and the inner diameter of the second end portion 721. That is, the welded portion M4 is not exposed on the inner walls of the first end portion 811 and the second end portion 721.

In the present embodiment, the first inner diameter enlarged portion 813 is formed on the upstream side with respect to the first joint surface 812 and the second joint surface 722, and the second inner diameter enlarged portion 723 is formed on the downstream side with respect to the first joint surface 812 and the second joint surface 722.

Therefore, even in a case where fuel in the fuel flow passage Rf1 intrudes between the inner periphery portion of the first joint surface 812 and the inner periphery portion of the second joint surface 722, and the pressure acts in a direction in which the first joint surface 812 and the second joint surface 722 are separated from each other, the pressure of fuel in the first inner diameter enlarged portion 813 and the second inner diameter enlarged portion 723 acts in the direction in which the first end portion 811 and the second end portion 721 approach each other, that is, in the direction in which the first joint surface 812 and the second joint surface 722 approach each other. In this way, the pressure acting in the vertical direction, that is, in the valve opening direction and the valve closing direction, that is, the pressure acting in the direction in which the first joint surface 812 and the second joint surface 722 are separated from each other can be canceled. Therefore, the stress in the welded portion M4 can be reduced with a simple configuration, and damage caused in the welded portion M4 can be restricted.

In the present embodiment, the inner diameter of the welded portion M4 is smaller than the inner diameter of the first inner diameter enlarged portion 813 and the inner diameter of the second inner diameter enlarged portion 723.

Therefore, it is possible to restrict fuel in the fuel flow passage Rf1 from entering the portion between the inner periphery portion of the first joint surface 812 and the inner periphery portion of the second joint surface 722. With this configuration, even in a case where pressure of fuel in the fuel flow passage Rf1 becomes high, the pressure in the direction in which the first tubular portion 81 and the second tubular portion 72 are separated from each other, that is, in the axial direction can be restricted from acting on the first tubular portion 81 and the second tubular portion 72. Therefore, the stress in the welded portion M4 can be further reduced, and damage caused in the welded portion M4 can be further restricted.

In the present embodiment, the inlet 80 as the first member has the surface 814 as a first inclined surface that is on the side opposite to the first joint surface 812 with respect to the first end portion 811 and is formed so as to be inclined with respect to the first joint surface 812. The pipe 70 as the second member has the surface 724 as a second inclined surface that is on the side opposite to the second joint surface 722 with respect to the second end portion 721 and is formed so as to be inclined with respect to the second joint surface 722. The surface 814 and the surface 724 are formed in a tapered surface shape.

With this configuration, load acting in the direction in which the first joint surface 812 and the second joint surface 722 approach each other and caused by the pressure of fuel in the first inner diameter enlarged portion 813 and the second inner diameter enlarged portion 723 can be efficiently applied to the inner peripheries of the first end portion 811 and the second end portion 721. Thus, damage of the welded portion M4 can be further restricted.

Further, the surfaces 814 and 724 are formed so as to be inclined with respect to the first joint surface 812 and the second joint surface 722. Therefore, workability of the first inner diameter enlarged portion 813 and the second inner diameter enlarged portion 723 can be improved.

Figure 5:
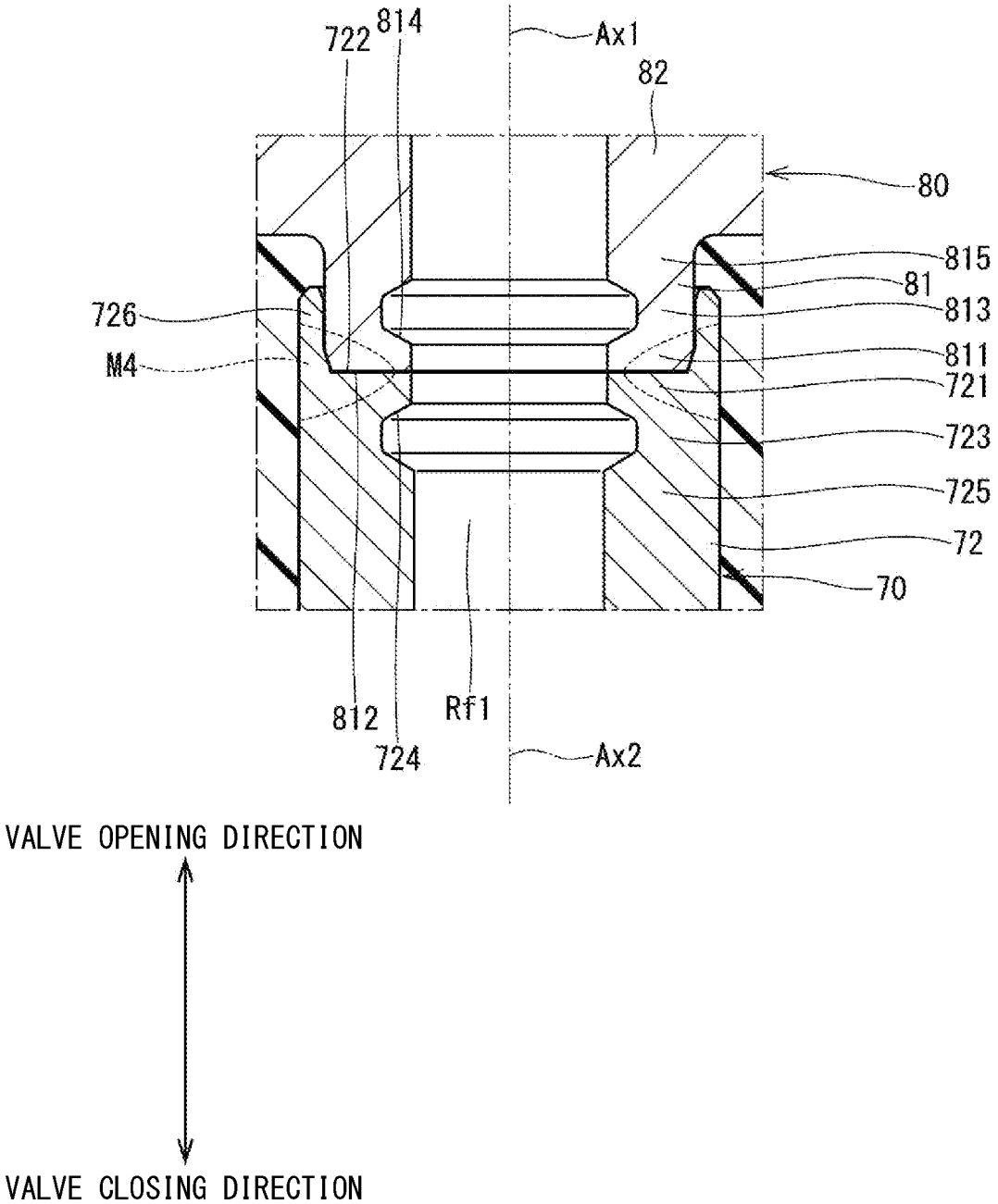
FIG. 5 is a cross-sectional view showing a joint portion between an inlet and the pipe of the fuel injection valve according to the first embodiment.

In the present embodiment, in the cross section including the axis Ax1 of the first tubular portion 81, the surface 814 of the first end portion 811 on the side opposite to the first joint surface 812 and the surface 724 of the second end portion 721 on the side opposite to the second joint surface 722 are formed so as to be symmetrical with respect to the first joint surface 812 and the second joint surface 722 (see FIG. 5).

Therefore, it is possible to restrict stress due to the difference in shape between the upper and lower surfaces of the first end portion 811 and the second end portion 721 and due to the difference in the amount of deformation between the inlet 80 and the pipe 70. Thus, damage of the welded portion M4 can be further restricted.

In the present embodiment, the first joint surface 812 and the second joint surface 722 are formed so as to be perpendicular to, that is, non-parallel to the axis Ax1 of the first tubular portion 81 and the axis Ax2 of the second tubular portion 72.

Therefore, even in a case where pressure acts on the inner walls of the first end portion 811 and the second end portion 721 radially outside, it is possible to restrict the first joint surface 812 and the second joint surface 722 from separating from each other. Thus, damage of the welded portion M4 can be further restricted.

In the present embodiment, the pipe 70 as the second member has the lower extended portion 726 that extends in a tubular shape from the outer periphery portion of one end surface of the second tubular portion 72, and its inner peripheral wall is configured to abut the first tubular portion 81.

Therefore, the inlet 80 as the first member and the pipe 70 as the second member can be positioned in the radial direction with a simple configuration.

In the present embodiment, the inlet 80 as the first member has the upper inner diameter reduced portion 815 that is formed on the side opposite to the first end portion 811 with respect to the first inner diameter enlarged portion 813 of the first tubular portion 81. The inner diameter of the lower inner diameter reduced portion 815 is smaller than the inner diameter of the first inner diameter enlarged portion 813.

Therefore, the first end portion 811, the first inner diameter enlarged portion 813, and the upper inner diameter reduced portion 815 can be formed at the same time by cutting the first tubular portion 81 so that a part of the substantially tubular inner wall of the first tubular portion 81 in the axial direction is annularly recessed outward in the radial direction.

In the present embodiment, the pipe 70 as the second member has the lower inner diameter reduced portion 725 that is formed on the side opposite to the second end portion 721 with respect to the second inner diameter enlarged portion 723 of the second tubular portion 72. The inner diameter of the lower inner diameter reduced portion 725 is smaller than the inner diameter of the second inner diameter enlarged portion 723.

Therefore, the second end portion 721, the second inner diameter enlarged portion 723, and the lower inner diameter reduced portion 725 can be formed at the same time by cutting the second tubular portion 72 so that a part of the substantially tubular inner wall of the second tubular portion 72 in the axial direction is annularly recessed outward in the radial direction.

In the present embodiment, the fuel injection valve 1 includes the housing 40 as the fuel flow passage member, the nozzle 30, the welded portion M1, the housing 50, the welded portion M2, the pipe 70, the fixed core 60, the welded portion M3, the inlet 80, and the welded portion M4, the injection portion 31, and the needle 91. The injection portion 31 is provided at one end of the nozzle 30 as the fuel flow passage member, and has the injection hole 311 for injecting fuel in the fuel flow passage Rf1. The needle 91 is provided in the fuel flow passage Rf1 and is configured to open and close the injection hole 311.

The fuel injection valve 1 includes the above-described fuel flow passage member. Therefore, in the fuel injection valve 1, damage of the welded portions M1 to M4 can be restricted. With this configuration, it is possible to restrict fuel in the fuel flow passage Rf1 from leaking to the outside of the fuel injection valve 1 through the welded portions M1 to M4. In particular, in a configuration in which the fuel injection valve 1 is used in such a manner that the pressure of fuel in the fuel flow passage Rf1 is high, damage of the welded portions M1 to M4 can be effectively restricted with a simple configuration without requiring an increase in body size or addition of a component.

Second Embodiment

Figure 6:
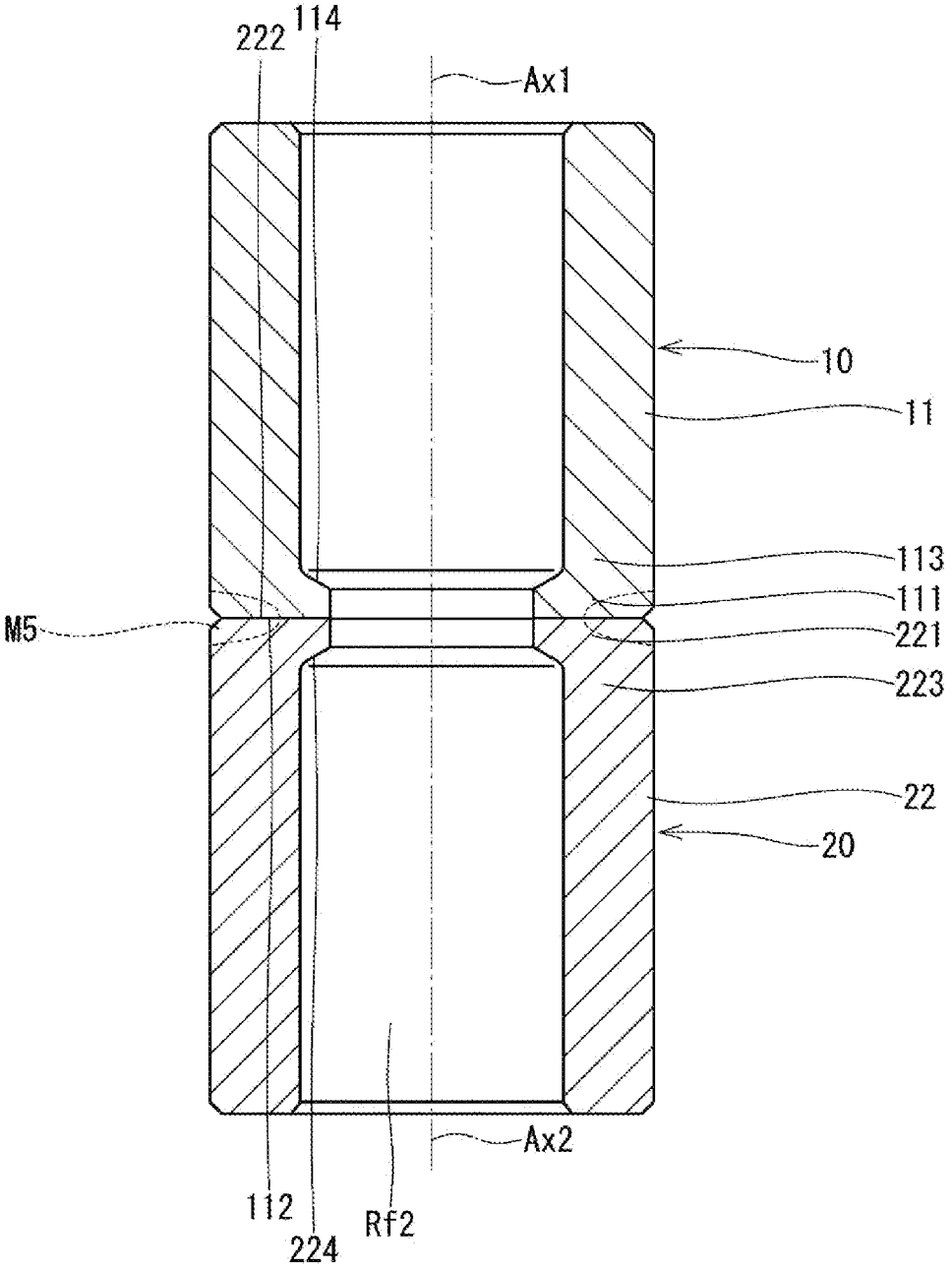
FIG. 6 is a cross-sectional view showing a fuel flow passage member according to a second embodiment.
Figure 7:
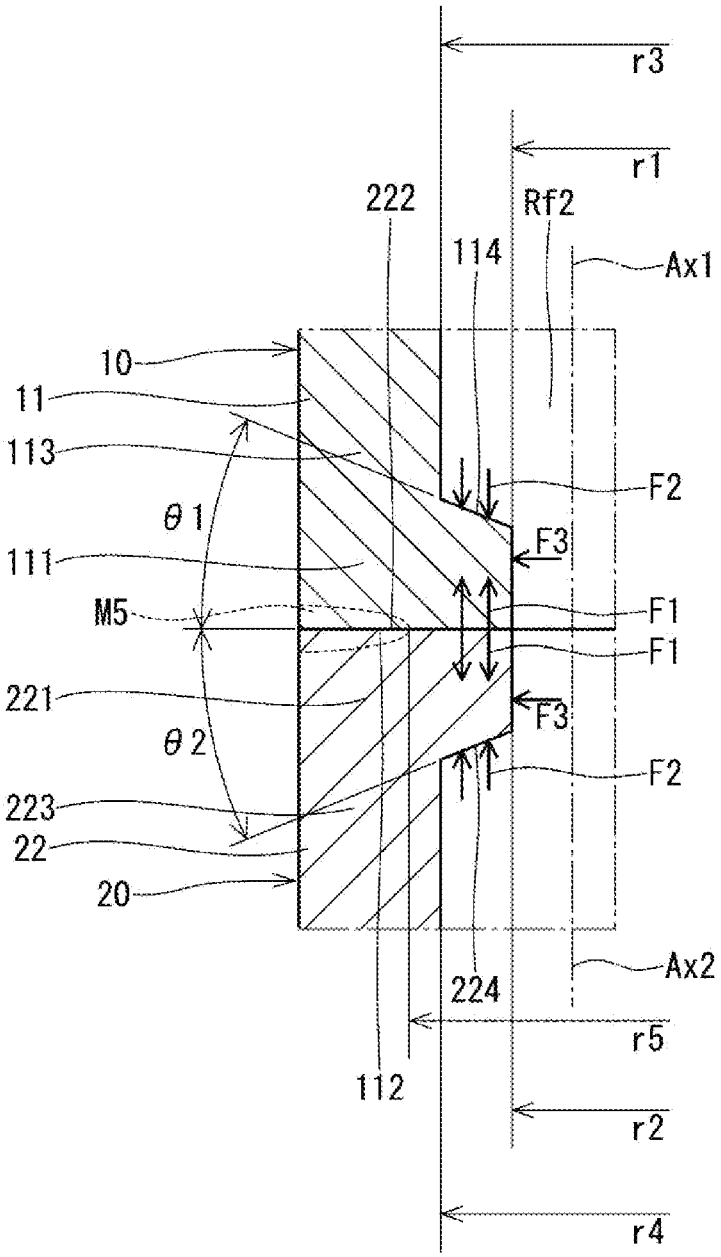
FIG. 7 is a cross-sectional view showing a joint portion between a first member and a second member of a fuel flow passage member according to the second embodiment.

A fuel flow passage member according to the second embodiment and a part thereof are shown in FIGS. 6 and 7.

In this embodiment, the fuel flow passage member is used, for example, as a part of a pipe or the like through which fuel supplied to a fuel injection valve or the like flows. The fuel flow passage member includes a first member 10, a second member 20, and a welded portion M5.

The first member 10 includes a first tubular portion 11, a first end portion 111, a first joint surface 112, and a first inner diameter enlarged portion 113. The first tubular portion 11 forms a part of a fuel flow passage Rf2 through which fuel flows therein. The first end portion 111 is formed at one end of the first tubular portion 11. The first joint surface 112 is formed on one end surface of the first tubular portion 11. The first inner diameter enlarged portion 113 is formed on the side opposite to the first joint surface 112 with respect to the first end portion 111 of the first tubular portion 11 and has an inner diameter r3 that is larger than an inner diameter r1 of the first end portion 111.

The second member 20 includes a second tubular portion 22, a second end portion 221, a second joint surface 222, a second inner diameter enlarged portion 223. The second tubular portion 22 forms a part of the fuel flow passage Rf2 therein. The second end portion 221 is formed on one end of the second tubular portion 22. The second joint surface 222 is formed on one end surface of the second tubular portion 22 and joined to the first joint surface 112. The second inner diameter enlarged portion 223 is formed on the side opposite to the second joint surface 222 with respect to the second end portion 221 of the second tubular portion 22 and has an inner diameter r4 that is larger than an inner diameter r2 of the second end portion 221.

The welded portion M5 is formed in an annular shape so as to extend radially inward from the radially outside of the first joint surface 112 and the second joint surface 222 by welding the first tubular portion 11 and the second tubular portion 12. An inner diameter r5 of the welded portion M5 is larger than the inner diameter r1 of the first end portion 111 and the inner diameter r2 of the second end portion 221 (see FIG. 7).

In the present embodiment, the first inner diameter enlarged portion 113 is formed on the upstream side with respect to the first joint surface 112 and the second joint surface 222, and the second inner diameter enlarged portion 223 is formed on the downstream side with respect to the first joint surface 112 and the second joint surface 222. Therefore, even in a case where fuel intrudes between the first joint surface 112 and the second joint surface 222, and a pressure F1 acts in a direction in which the first joint surface 112 and the second joint surface 222 are separated from each other, a pressure F2 of fuel in the first inner diameter enlarged portion 113 and the second inner diameter enlarged portion 223 acts in the direction in which the first end portion 111 and the second end portion 221 approach each other, that is, in the direction in which the first joint surface 112 and the second joint surface 222 approach each other (see FIG. 7). In this way, the pressure F1 in the vertical direction acting in the direction in which the first joint surface 112 and the second joint surface 222 are separated from each other can be canceled. Therefore, the stress in the welded portion M5 can be reduced with a simple configuration, and damage caused in the welded portion M5 can be restricted.

In the present embodiment, the inner diameter r1 of the first end portion 111 and the inner diameter r2 of the second end portion 221 are substantially the same as each other. Further, the inner diameter r3 of the first inner diameter enlarged portion 113 and the inner diameter r4 of the second inner diameter enlarged portion 223 are substantially the same as each other. The inner diameter r5 of the welded portion M5 is larger than the inner diameter r3 of the first inner diameter enlarged portion 113 and the inner diameter r4 of the second inner diameter enlarged portion 223 (see FIG. 7).

The first member 10 is formed so that its inner diameter is the same as the inner diameter r3 of the first inner diameter enlarged portion 113 from the first inner diameter enlarged portion 113 to the end portion opposite to the first end portion 111. The second member 20 is formed so that its inner diameter is the same as the inner diameter r4 of the second inner diameter enlarged portion 223 from the second inner diameter enlarged portion 223 to the end opposite to the second end portion 221 (see FIGS. 6 and 7).

In the present embodiment, the first member 10 has a surface 114 as a first inclined surface that is on the side opposite to the first joint surface 112 with respect to the first end portion 111 and is formed so as to be inclined with respect to the first joint surface 112. The second member 20 has a surface 224 as a second inclined surface that is on the side opposite to the second joint surface 222 with respect to the second end portion 221 and is formed so as to be inclined with respect to the second joint surface 222. The surface 114 and the surface 224 are formed in a tapered surface shape.

With this configuration, load acting in the direction in which the first joint surface 112 and the second joint surface 222 approach each other and caused by the pressure F2 of fuel in the first inner diameter enlarged portion 113 and the second inner diameter enlarged portion 223 can be efficiently applied to the inner peripheries of the first end portion 111 and the second end portion 221. Thus, damage of the welded portion M5 can be further restricted.

Further, the surfaces 114 and 224 are formed so as to be inclined with respect to the first joint surface 112 and the second joint surface 222. Therefore, workability of the first inner diameter enlarged portion 113 and the second inner diameter enlarged portion 223 can be improved.

Herein, the angle θ1 formed between the first joint surface 112 and the surface 114 is about 30 degrees. The angle θ2 formed between the second joint surface 222 and the surface 224 is about 30 degrees. It is desirable that θ1 and θ2 are set in the range of 10 to 50 degrees.

In the present embodiment, in the cross section including the axis Ax1 of the first tubular portion 11, the surface 114 of the first end portion 111 on the side opposite to the first joint surface 112 and the surface 224 of the second end portion 221 on the side opposite to the second joint surface 222 are formed so as to be symmetrical with respect to the first joint surface 112 and the second joint surface 222 (see FIGS. 6 and 7).

Therefore, it is possible to restrict stress due to the difference in shape between the upper and lower surfaces of the first end portion 111 and the second end portion 221 and due to the difference in the amount of deformation between the first member 10 and the second member 20. Thus, damage of the welded portion M5 can be further restricted.

In the present embodiment, the first joint surface 112 and the second joint surface 222 are formed so as to be perpendicular to, that is, non-parallel to the axis Ax1 of the first tubular portion 11 and the axis Ax2 of the second tubular portion 22.

Therefore, even in a case where pressure F3 acts on the inner walls of the first end portion 111 and the second end portion 221 radially outside, it is possible to restrict the first joint surface 112 and the second joint surface 222 from separating from each other. Thus, damage of the welded portion M5 can be further restricted.

Next, the present embodiment and a first comparative embodiment are compared with each other.

Figure 8:
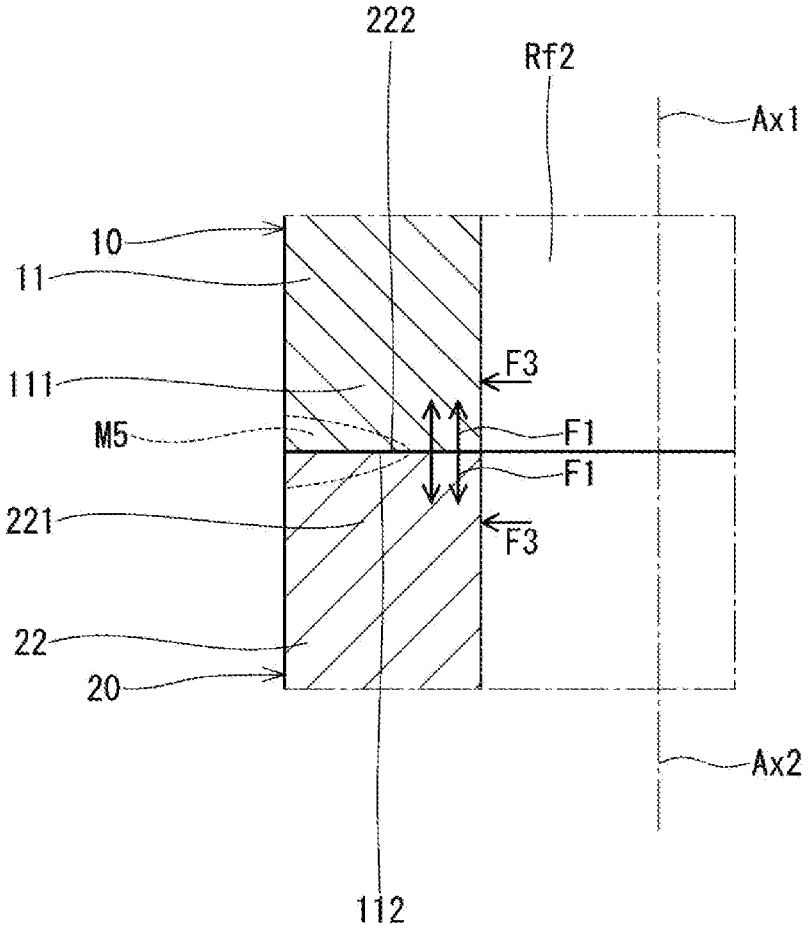
FIG. 8 is a cross-sectional view showing a joint portion between a first member and a second member of a fuel flow passage member according to a first comparative embodiment.

As shown in FIG. 8, in the first comparative embodiment, the first member 10 does not have the first inner diameter enlarged portion 113. Further, the second member 20 does not have the second inner diameter enlarged portion 223.

Therefore, in a case where fuel intrudes between the first joint surface 112 and the second joint surface 222, and the pressure F1 acts in the direction in which the first joint surface 112 and the second joint surface 222 are separated from each other, the pressure (F2), which cancels that, does not arise, dissimilarly to the present embodiment. As a result, stress in the welded portion M5 increases, and the welded portion M5 may be damaged.

To the contrary, in the present embodiment, the first inner diameter enlarged portion 113 is formed on the upstream side with respect to the first joint surface 112 and the second joint surface 222, and the second inner diameter enlarged portion 223 is formed on the downstream side with respect to the first joint surface 112 and the second joint surface 222. Therefore, even in a case where fuel intrudes between the first joint surface 112 and the second joint surface 222, and the pressure F1 acts in a direction in which the first joint surface 112 and the second joint surface 222 are separated from each other, the pressure F2 of fuel in the first inner diameter enlarged portion 113 and the second inner diameter enlarged portion 223 acts in the direction in which the first joint surface 112 and the second joint surface 222 approach each other. In this way, the pressure F1 in the vertical direction acting in the direction in which the first joint surface 112 and the second joint surface 222 are separated from each other can be canceled. Therefore, occurrence of the above-mentioned issue in the first comparative embodiment can be restricted.

In the first comparative embodiment, the first joint surface 112 and the second joint surface 222 are formed so as to be perpendicular to the axis Ax1 of the first tubular portion 11 and the axis Ax2 of the second tubular portion 22. Therefore, even in a case where the pressure F3 acts on the inner walls of the first end portion 111 and the second end portion 221 radially outside, it is possible to restrict the first joint surface 112 and the second joint surface 222 from separating from each other, similarly to the present embodiment.

Next, the present embodiment and a second comparative embodiment are compared with each other.

Figure 9:
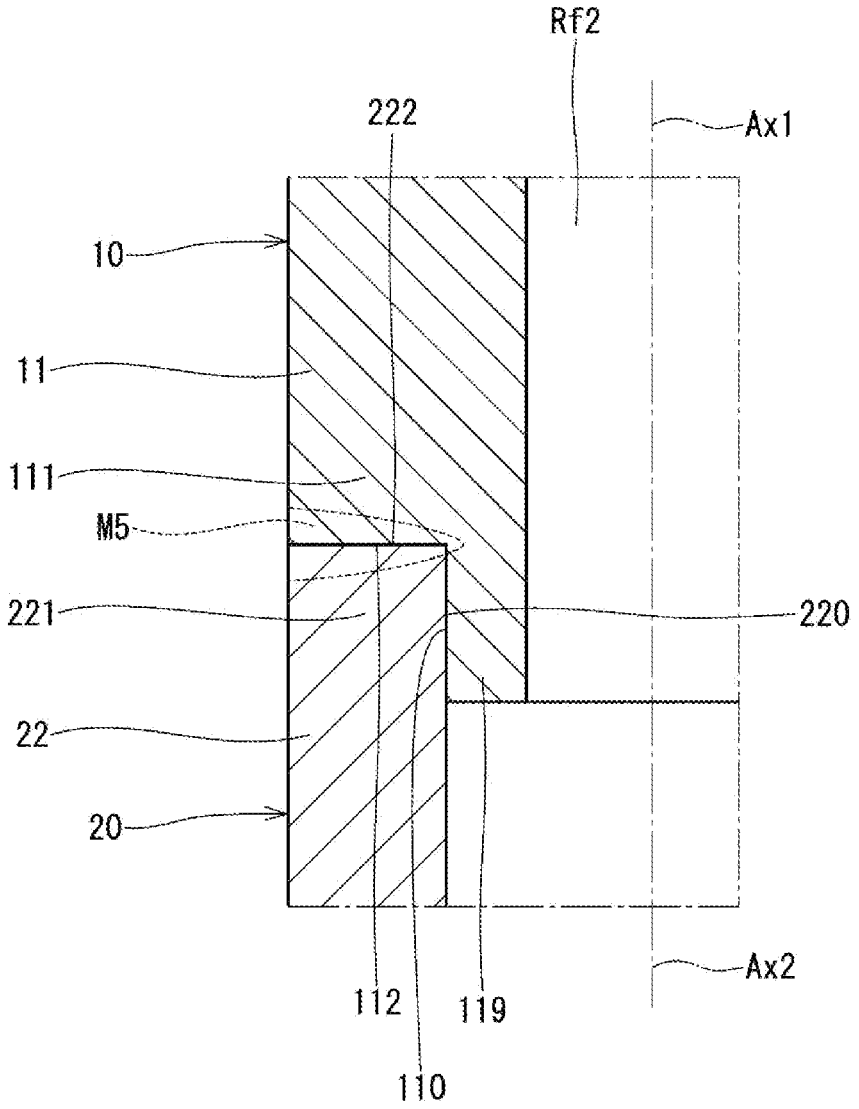
FIG. 9 is a cross-sectional view showing a joint portion between a first member and a second member of a fuel flow passage member according to a second comparative embodiment.
Figure 10:
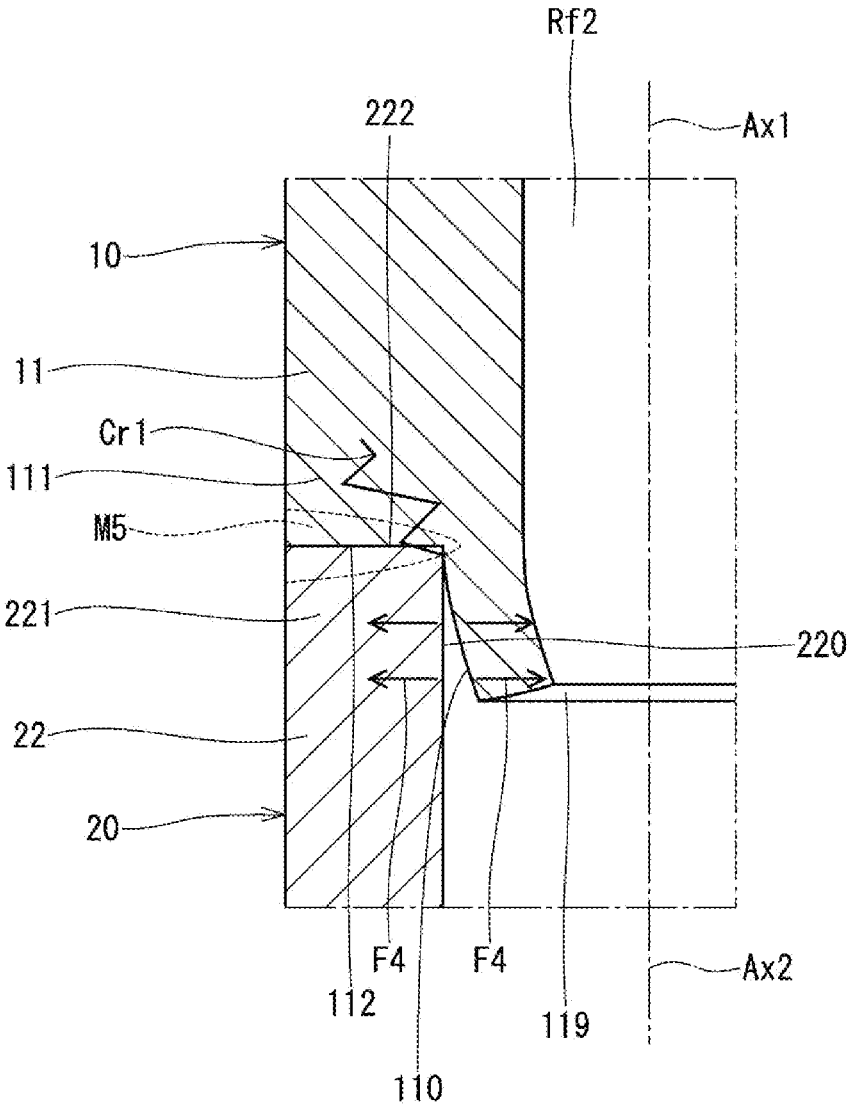
FIG. 10 is a cross-sectional view showing a joint portion between a first member and a second member of a fuel flow passage member according to a second comparative embodiment.

As shown in FIGS. 9 and 10, in the second comparative embodiment, the first member 10 does not have the first inner diameter enlarged portion 113. Further, the second member 20 does not have the second inner diameter enlarged portion 223. The inner diameter of the first tubular portion 11 is smaller than the inner diameter of the second tubular portion 22. The first member 10 has an upper extended portion 119 that extends in a tubular form from the inner periphery portion of one end surface of the first tubular portion 11 and has an outer peripheral wall that is configured to come into contact with the inner peripheral wall of the second tubular portion 22. A first joint surface 110 in a tubular form is formed on the outer peripheral wall of the upper extended portion 119. A second joint surface 220 in a tubular form, which is to be joined to the first joint surface 110, is formed on the inner peripheral wall of the second tubular portion 22. The inner diameter of the welded portion M5 is smaller than the inner diameter of the second tubular portion 22 and is larger than the inner diameter of the first tubular portion 11.

In the second comparative embodiment, the first joint surface 110 and the second joint surface 220 are formed so as to be in parallel to the axis Ax1 of the first tubular portion 11 and the axis Ax2 of the second tubular portion 22.

Therefore, in a case where fuel intrudes between the first joint surface 110 and the second joint surface 220, and a pressure F4 acts in the direction in which the first joint surface 110 and the second joint surface 220 are separated from each other, the upper extended portion 119 may be deformed in the direction in which the first joint surface 110 and the second joint surface 220 are separated from each other due to the difference in wall thickness and rigidity between the first member 10 and the second member 20. In a case where the upper extended portion 119 is deformed in the direction in which the first joint surface 110 and the second joint surface 220 are separated from each other, stress may arise between the first joint surface 112 and the first joint surface 110 of the first tubular portion 11 to cause a crack Cr1. As a result, the welded portion M5 may be damaged (see FIG. 10).

To the contrary, in the present embodiment, the first joint surface 112 and the second joint surface 222 are formed so as to be perpendicular to the axis Ax1 of the first tubular portion 11 and the axis Ax2 of the second tubular portion 22 and does not have the upper extended portion 119. Therefore, occurrence of the above-mentioned issue in the second comparative embodiment can be restricted.

Third Embodiment

Figure 11:
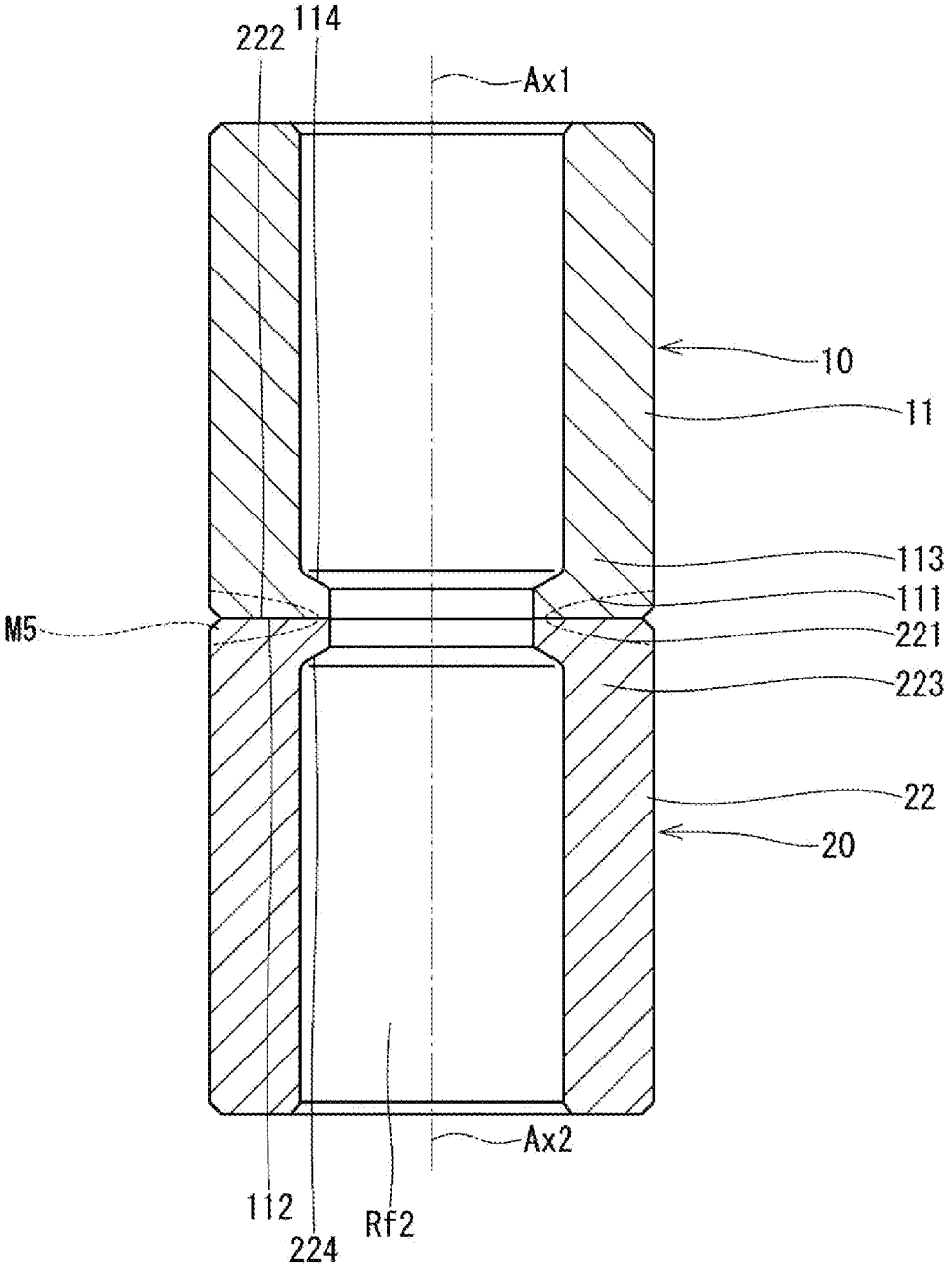
FIG. 11 is a cross-sectional view showing a fuel flow passage member according to a third embodiment.
Figure 12:
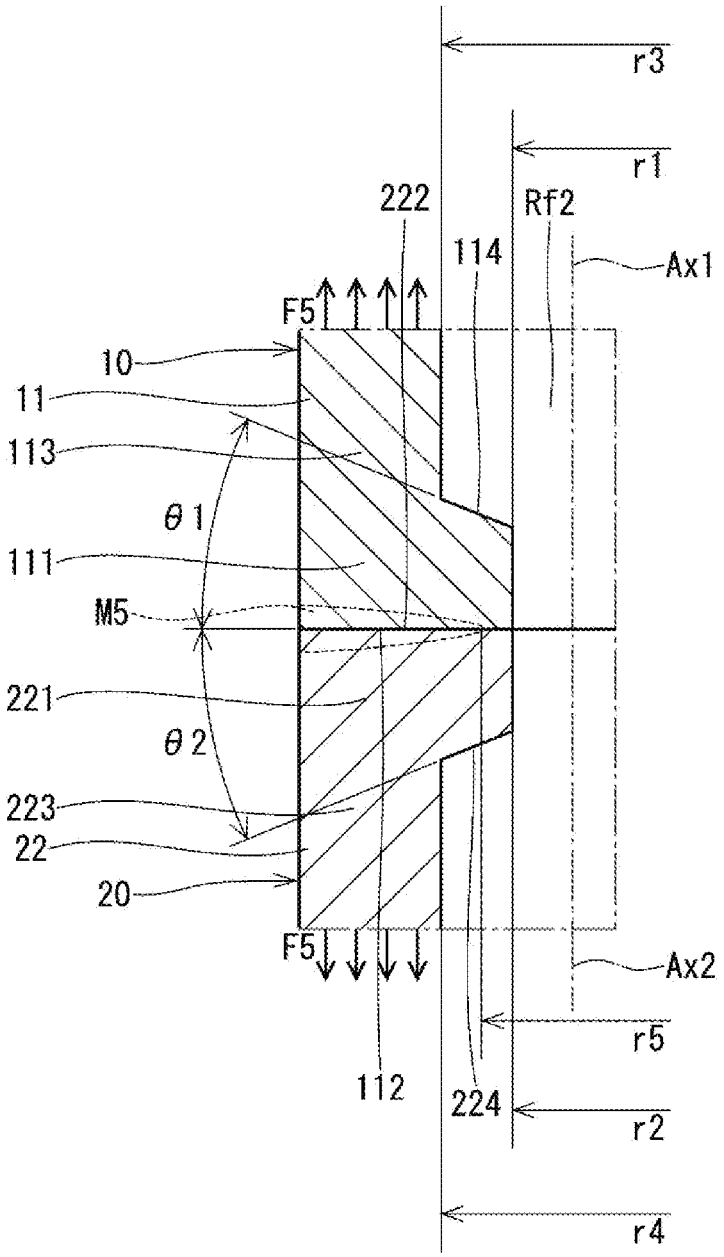
FIG. 12 is a cross-sectional view showing a joint portion between a first member and a second member of the fuel flow passage member according to the third embodiment.

A fuel flow passage member according to the third embodiment and a part thereof are shown in FIGS. 11 and 12. In the third embodiment, the configuration of the welded portion M5 is different from that in the second embodiment.

In the present embodiment, the inner diameter r5 of the welded portion M5 is larger than the inner diameter r1 of the first end portion 111 and the inner diameter r2 of the second end portion 221. In addition, the inner diameter r5 is smaller than the inner diameter r3 of the first inner diameter enlarged portion 113 and the inner diameter r4 of the second inner diameter enlarged portion 223 (see FIG. 12).

Therefore, compared with the second embodiment, it is possible to restrict fuel in the fuel flow passage Rf2 from entering the portion between the inner periphery portion of the first joint surface 112 and the inner periphery portion of the second joint surface 222. With this configuration, even in a case where pressure of fuel in the fuel flow passage Rf2 becomes high, a pressure F5 in the direction in which the first tubular portion 11 and the second tubular portion 22 are separated from each other, that is, in the axial direction can be restricted from acting on the first tubular portion 11 and the second tubular portion 22. Therefore, the stress in the welded portion M5 can be further reduced, and damage caused in the welded portion M5 can be further restricted.

Fourth Embodiment

Figure 13:
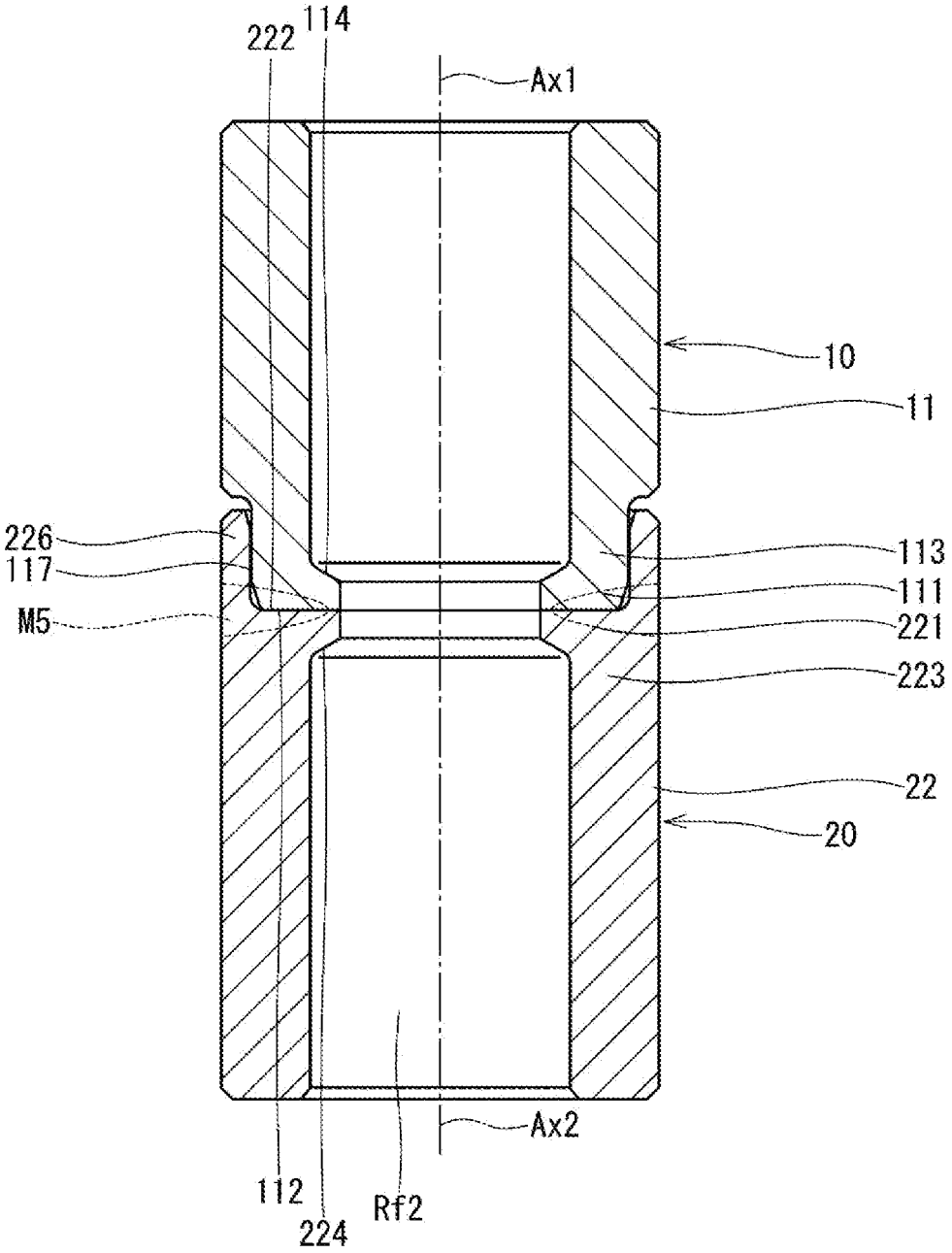
FIG. 13 is a cross-sectional view showing a fuel flow passage member according to a fourth embodiment.

A fuel flow passage member according to the fourth embodiment is shown in FIG. 13. In the fourth embodiment, the configurations of the first member 10 and the second member 20 are different from those in the third embodiment.

In the present embodiment, the first tubular portion 11 has a reduced diameter portion 117 on one end side. The outer diameter of the reduced diameter portion 117 is smaller than the outer diameter of a portion of the first tubular portion 11 other than the reduced diameter portion 117.

In the present embodiment, the second member 20 has a lower extended portion 226 that extends in a tubular shape from the outer periphery portion of one end surface of the second tubular portion 22, and its inner peripheral wall is configured to abut the reduced diameter portion 117 of the first tubular portion 11.

Therefore, the first member 10 and the second member 20 can be positioned in the radial direction with a simple configuration.

Fifth Embodiment

Figure 14:
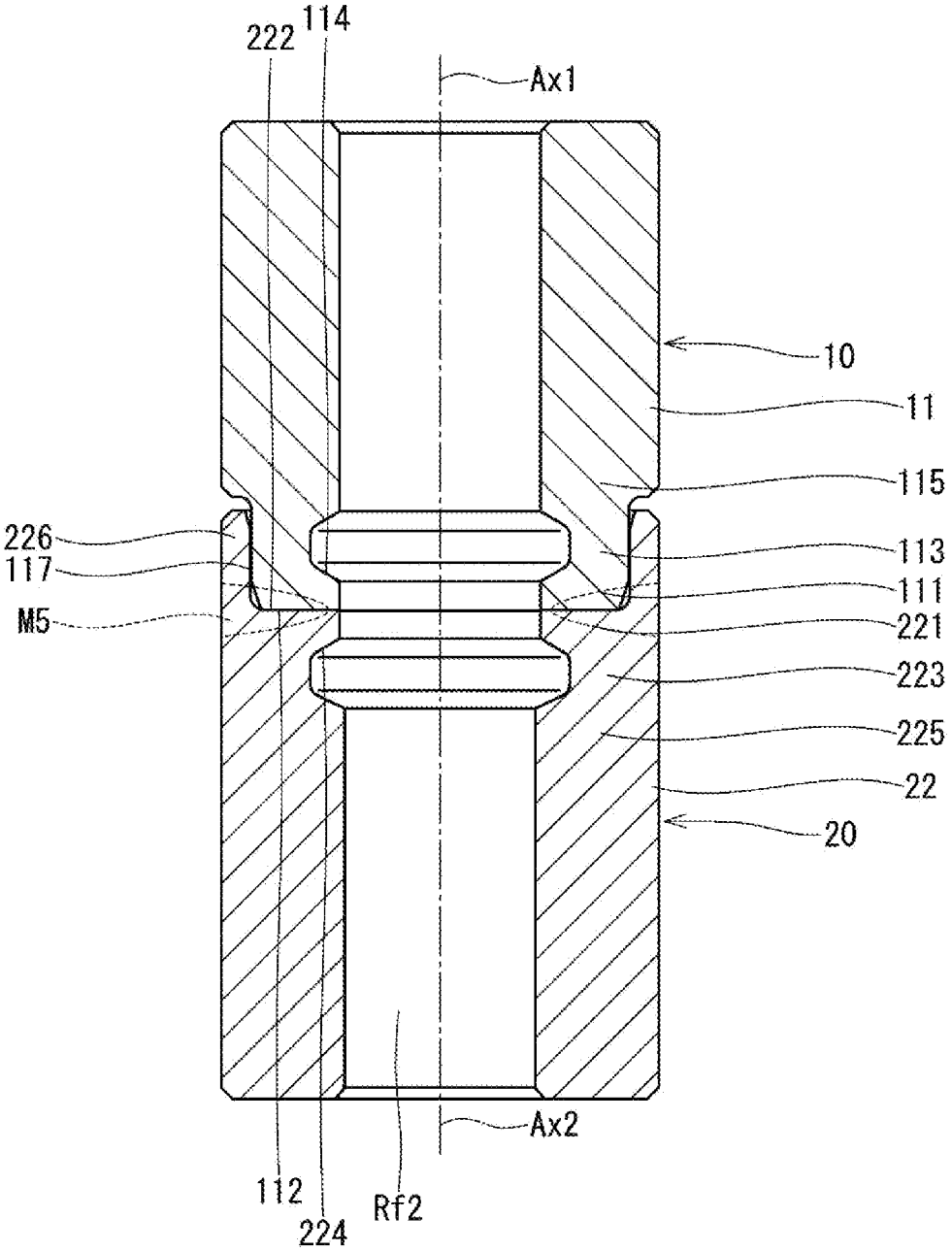
FIG. 14 is a cross-sectional view showing a fuel flow passage member according to a fifth embodiment.

A fuel flow passage member according to the fifth embodiment is shown in FIG. 14. In the fifth embodiment, the configurations of the first member 10 and the second member 20 are different from those in the fourth embodiment.

In the present embodiment, the first member 10 has an upper inner diameter reduced portion 115 that is formed on the side opposite to the first end portion 111 with respect to the first inner diameter enlarged portion 113 of the first tubular portion 11. The inner diameter of the upper inner diameter reduced portion 115 is smaller than the inner diameter of the first inner diameter enlarged portion 113.

Therefore, the first end portion 111, the first inner diameter enlarged portion 113, and the upper inner diameter reduced portion 115 can be formed at the same time by cutting the first tubular portion 11 so that a part of the substantially tubular inner wall of the first tubular portion 11 in the axial direction is annularly recessed outward in the radial direction.

In the present embodiment, the inner diameter of the first end portion 111 and the inner diameter of the upper inner diameter reduced portion 115 are substantially the same as each other.

In the present embodiment, the second member 20 has a lower inner diameter reduced portion 225 that is formed on the side opposite to the second end portion 221 with respect to the second inner diameter enlarged portion 223 of the second tubular portion 22. The inner diameter of the lower inner diameter reduced portion 225 is smaller than the inner diameter of the second inner diameter enlarged portion 223.

Therefore, the second end portion 221, the second inner diameter enlarged portion 223, and the lower inner diameter reduced portion 225 can be formed at the same time by cutting the second tubular portion 22 so that a part of the substantially tubular inner wall of the second tubular portion 22 in the axial direction is annularly recessed outward in the radial direction.

In the present embodiment, the inner diameter of the second end portion 221 and the inner diameter of the lower inner diameter reduced portion 225 are substantially the same as each other.

The first member 10 is formed so that the inner diameter is the same as the inner diameter of the upper inner diameter reduced portion 115 from the upper inner diameter reduced portion 115 to the end portion on the side opposite to the first end portion 111. The second member 20 is formed so that the inner diameter is the same as the inner diameter of the lower inner diameter reduced portion 225 from the lower inner diameter reduced portion 225 to the end opposite to the second end portion 221 (see FIG. 14).

Sixth Embodiment

Figure 15:
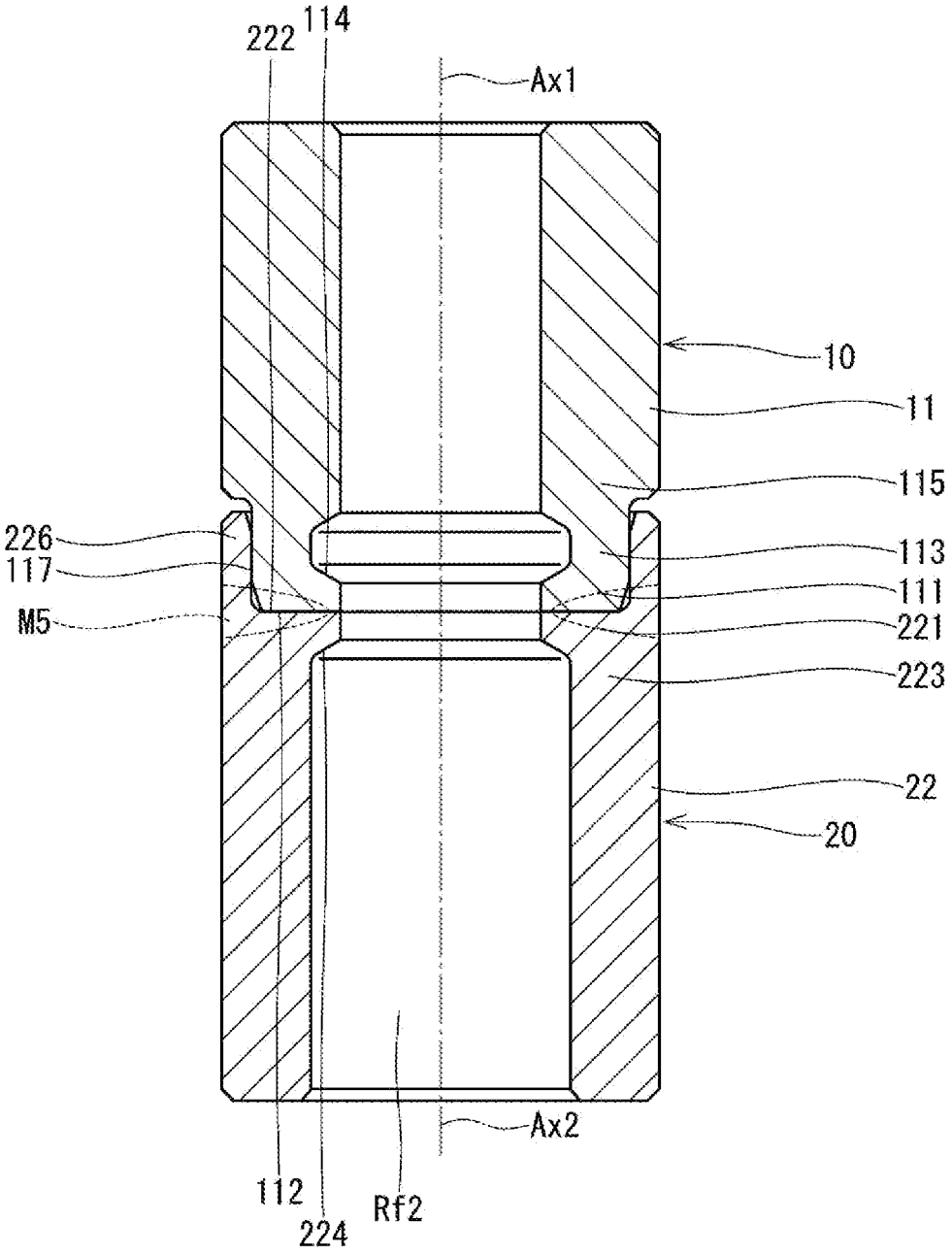
FIG. 15 is a cross-sectional view showing a fuel flow passage member according to a sixth embodiment.

A fuel flow passage member according to the sixth embodiment is shown in FIG. 15. In the sixth embodiment, the configurations of the second member 20 and the like are different from those in the fifth embodiment.

In the present embodiment, the second member 20 does not have the lower inner diameter reduced portion 225. Other configurations are the same as those in the fifth embodiment.

Seventh Embodiment

Figure 16:
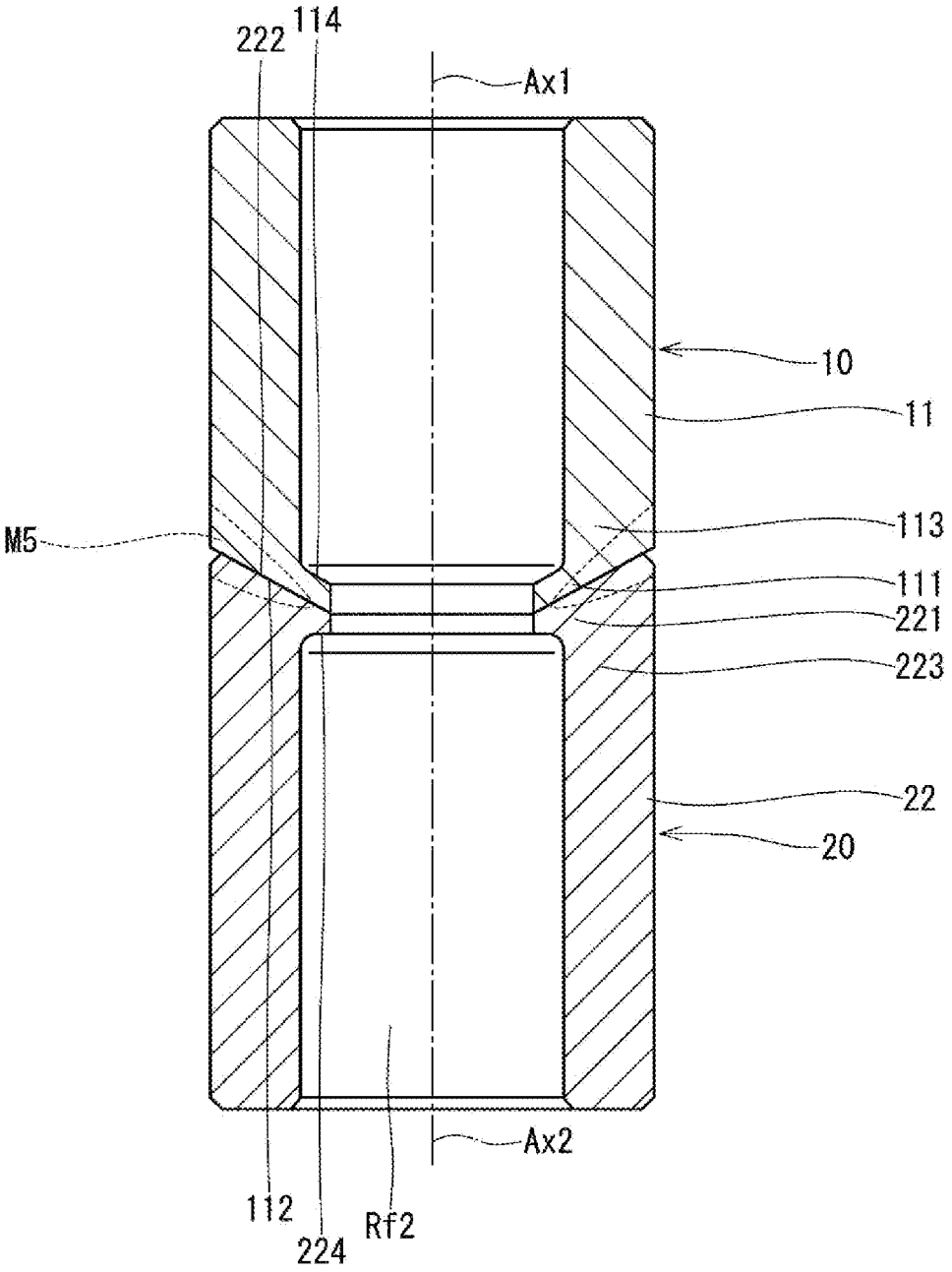
FIG. 16 is a cross-sectional view showing a fuel flow passage member according to a seventh embodiment.

A fuel flow passage member according to the seventh embodiment is shown in FIG. 16. In the seventh embodiment, the configurations of the first member 10 and the second member 20 are different from those in the third embodiment.

In the present embodiment, the first joint surface 112 and the second joint surface 222 are formed so as to be inclined relative to, that is, non-parallel to the axis Ax1 of the first tubular portion 11 and the axis Ax2 of the second tubular portion 22.

Therefore, even in a case where pressure acts on the inner walls of the first end portion 111 and the second end portion 221 radially outside, it is possible to restrict the first joint surface 112 and the second joint surface 222 from separating from each other, similarly to the third embodiment. Thus, damage of the welded portion M5 can be restricted.

In the present embodiment, in the cross section including the axis Ax1 of the first tubular portion 11, the surface 114 of the first end portion 111 on the side opposite to the first joint surface 112 and the surface 224 of the second end portion 221 on the side opposite to the second joint surface 222 are formed so as to be non-symmetrical with respect to the first joint surface 112 and the second joint surface 222.

Other Embodiments

In the above embodiment, an example is shown in which the first member has the first inclined surface formed so as to be inclined with respect to the first joint surface on the side opposite to the first joint surface of the first end portion, and the second member has the second inclined surface formed so as to be inclined with respect to the second joint surface on the side opposite to the second joint surface of the second end portion. On the other hand, in another embodiment, the first member may have a surface formed so as to be parallel to the first joint surface on the side opposite to the first joint surface of the first end portion, and the second member may have a surface formed so as to be parallel to the second joint surface on the side opposite to the second joint surface of the second end portion.

Further, in the above-described first embodiment, an example is shown in which the nozzle 30, the housing 40, and the housing 50 are formed separately and joined to each other. On the other hand, in another embodiment, at least two of the nozzle 30, the housing 40, and the housing 50 may be integrally formed of the same material. In this way, the number of components can be reduced, and the joining process and the like can be omitted.

Further, in the above-described first embodiment, an example is shown in which the housing 50, the magnetic throttle portion 3, and the fixed core 60 are formed separately and joined to each other. On the other hand, in another embodiment, the housing 50, the magnetic throttle portion 3, and the fixed core 60 may be integrally formed of the same material. In this case, for example, when the wall thickness of the magnetic throttle portion 3 in the radial direction is made sufficiently smaller than the wall thickness of the housing 50 and the fixed core 60 in the radial direction, the number of members can be reduced without losing the function as the magnetic throttle portion 3.

Further, in the above-described first embodiment, an example is shown in which the fixed core 60, the pipe 70, and the inlet 80 are formed separately and joined to each other. On the other hand, in another embodiment, at least two of the fixed core 60, the pipe 70, and the inlet 80 may be integrally formed of the same material. In this way, the number of components can be reduced, and the joining process and the like can be omitted.

Thus, the present disclosure is not limited to the above embodiments but can be implemented in various forms without departing from the scope thereof.

The present disclosure has been described based on the embodiments. However, the present disclosure is not limited to the embodiments and configurations. This disclosure also encompasses various modifications and variations within the scope of equivalents. Furthermore, various combination and formation, and other combination and formation including one, more than one or less than one element may be made in the present disclosure.

What is claimed is:

1. A fuel flow passage member comprising:

a first member including a first tubular portion that forms a part of a fuel flow passage configured to cause fuel to flow therein, a first end portion that is formed at one end of the first tubular portion, a first joint surface that is formed in one end surface of the first tubular portion, and a first inner diameter enlarged portion that is formed on a side opposite to the first joint surface with respect to the first end portion of the first tubular portion and that has an inner diameter larger than an inner diameter of the first end portion;

a second member including a second tubular portion that forms a part of the fuel flow passage therein, a second end portion that is formed at one end of the second tubular portion, a second joint surface that is formed in one end surface of the second tubular portion and joined to the first joint surface, and a second inner diameter enlarged portion that is formed on a side opposite to the second joint surface with respect to the second end portion of the second tubular portion and that has an inner diameter larger than an inner diameter of the second end portion; and a welded portion that is in an annular shape and formed by welding the first tubular portion and the second tubular portion to extend radially inward from a radially outside of the first joint surface and the second joint surface, wherein an inner diameter of the welded portion is larger than the inner diameter of the first end portion and the inner diameter of the second end portion, and an inner periphery portion of the first joint surface and an inner periphery portion of the second joint surface are joined with each other in an axial direction and are located between the first inner diameter enlarged portion and the second inner diameter enlarged portion in the axial direction.

2. The fuel flow passage member according to claim 1, wherein the inner diameter of the welded portion is smaller than the inner diameter of the first inner diameter enlarged portion and the inner diameter of the second inner diameter enlarged portion.

3. The fuel flow passage member according to claim 1, wherein the first member has a first inclined surface formed on a side opposite to the first joint surface with respect to the first end portion and inclined with respect to the first joint surface, and the second member has a second inclined surface formed on a side opposite to the second joint surface with respect to the second end portion and inclined with respect to the second joint surface.

4. The fuel flow passage member according to claim 1, wherein in a cross section including an axis of the first tubular portion, a surface of the first end portion on a side opposite to the first joint surface and a surface of the second end portion on a side opposite to the second joint surface are symmetrical to each other with respect to the first joint surface and the second joint surface.

5. The fuel flow passage member according to claim 1, wherein the first joint surface and the second joint surface are perpendicular to or inclined with respect to an axis of the first tubular portion and an axis of the second tubular portion.

6. The fuel flow passage member according to claim 5, wherein the first joint surface and the second joint surface are perpendicular to the axis of the first tubular portion and the axis of the second tubular portion.

7. The fuel flow passage member according to claim 1, wherein the first member includes an upper extended portion that is in a tubular shape and extends from an outer periphery of the one end surface of the first tubular portion, and the upper extended portion has an inner peripheral wall that is configured to be in contact with an outer peripheral wall of the second tubular portion.

8. The fuel flow passage member according to claim 1, wherein the second member includes a lower extended portion that is in a tubular shape and extends from an outer periphery of the one end surface of the second tubular portion, and the lower extended portion has an inner peripheral wall that is configured to be in contact an outer peripheral wall of the first tubular portion.

9. The fuel flow passage member according to claim 1, wherein the first member includes an upper inner diameter reduced portion on a side opposite to the first end portion with respect to the first inner diameter enlarged portion of the first tubular portion, and the upper inner diameter reduced portion has an inner diameter that is smaller than the inner diameter of the first inner diameter enlarged portion.

10. The fuel flow passage member according to claim 1, wherein the second member includes a lower inner diameter reduced portion on a side opposite to the second end portion with respect to the second inner diameter enlarged portion of the second tubular portion, and the lower inner diameter reduced portion has an inner diameter that is smaller than the inner diameter of the second inner diameter enlarged portion.

11. A fuel injection valve comprising:

the fuel flow passage member according to claim 1;

an injection portion that is provided at one end of the fuel flow passage member and having an injection hole to inject fuel in the fuel flow passage; and a needle that is provided in the fuel flow passage and configured to open and close the injection hole.

12. The fuel flow passage member according to claim 1, wherein the inner periphery portion of the first joint surface forms an inner wall of the first end portion, and the inner periphery portion of the second joint surface forms an inner wall of the second end portion.

13. The fuel flow passage member according to claim 12, wherein the welded portion extends radially inward from a radially outside of the inner periphery portion of the first joint surface and the inner periphery portion of the second joint surface.

14. The fuel injection valve according to claim 11, wherein the needle is located on an inside of the inner periphery portion of the first joint surface and the inner periphery portion of the second joint surface in a radial direction and are distant from the inner periphery portion of the first joint surface and the inner periphery portion of the second joint surface in the radial direction.

* * * * *